US009040907B2

(12) United States Patent
Brucker et al.

(10) Patent No.: US 9,040,907 B2
(45) Date of Patent: May 26, 2015

(54) METHOD AND APPARATUS FOR TUNING AN ELECTROSTATIC ION TRAP

(71) Applicant: MKS Instruments, Inc., Andover, MA (US)

(72) Inventors: Gerardo A. Brucker, Longmont, CO (US); G. Jeffery Rathbone, Longmont, CO (US); Brian J. Horvath, Thornton, CO (US); Timothy C. Swinney, Fort Colling, CO (US); Stephen C. Blouch, Boulder, CO (US); Jeffrey G. McCarthy, Lafayette, CO (US); Timothy R. Piwonka-Corle, Boulder, CO (US)

(73) Assignee: MKS Instruments, Inc., Andover, MA (US)

( * ) Notice: Subject to any disclaimer, the term of this patent is extended or adjusted under 35 U.S.C. 154(b) by 0 days.

(21) Appl. No.: 14/354,227

(22) PCT Filed: Oct. 30, 2012

(86) PCT No.: PCT/US2012/062599

§ 371 (c)(1),
(2) Date: Apr. 25, 2014

(87) PCT Pub. No.: WO2013/066881

PCT Pub. Date: May 10, 2013

(65) Prior Publication Data

US 2014/0264068 A1 Sep. 18, 2014

Related U.S. Application Data

(60) Provisional application No. 61/719,668, filed on Oct. 29, 2012, provisional application No. 61/553,779, filed on Oct. 31, 2011.

(51) Int. Cl.

| | |
|---|---|
| ***H01J 49/42*** | (2006.01) |
| ***H01J 49/00*** | (2006.01) |
| ***H01J 49/14*** | (2006.01) |
| ***H01J 27/20*** | (2006.01) |

(52) U.S. Cl.

CPC ..... *H01J 49/4245* (2013.01); *H01J 49/0009* (2013.01); *H01J 49/0031* (2013.01); *H01J 49/147* (2013.01); *H01J 27/205* (2013.01)

(58) Field of Classification Search

CPC ... H01J 49/424; H01J 49/4245; H01J 49/427; H01J 49/0009; H01J 49/4225; H01J 49/423; B01D 59/44

USPC ..... 250/292, 282, 281, 288, 283, 489, 250/423 R, 424

See application file for complete search history.

(56) References Cited

U.S. PATENT DOCUMENTS

| | | | | |
|---|---|---|---|---|
| 6,294,780 | B1 * | 9/2001 | Wells et al. | 250/288 |
| 8,586,918 | B2 * | 11/2013 | Brucker et al. | 250/292 |
| 2002/0162957 | A1 * | 11/2002 | Smith et al. | 250/292 |
| 2009/0194680 | A1 | 8/2009 | Quarmby et al. | |
| 2010/0127167 | A1 * | 5/2010 | Schropp et al. | 250/288 |

FOREIGN PATENT DOCUMENTS

WO WO 2010/129690 11/2010

OTHER PUBLICATIONS

International Search Report dated Jun. 28, 2013 for PCT/US2012/062599 entitled "Method and Apparatus for Tuning Electrostatic Ion Trap".

* cited by examiner

*Primary Examiner* — Nikita Wells

(74) *Attorney, Agent, or Firm* — Hamilton, Brook, Smith & Reynolds, P.C.

(57) ABSTRACT

An apparatus includes an electrostatic ion trap and electronics configured to measure parameters of the ion trap and configured to adjust ion trap settings based on the measured parameters. A method of tuning the electrostatic ion trap includes, under automatic electronic control, measuring parameters of the ion trap and adjusting ion trap settings based on the measured parameters.

40 Claims, 44 Drawing Sheets

230

200

215

220

METHOD AND APPARATUS FOR TUNING AN ELECTROSTATIC ION TRAP

RELATED APPLICATION(S)

This application is the U.S. National Stage of International Application No. PCT/US2012/062599, filed on Oct. 30, 2012, published in English, which claims the benefit of U.S. Provisional Application No. 61/719,668, filed on Oct. 29, 2012 and U.S. Provisional Application No. 61/553,779, filed on Oct. 31, 2011. The entire teachings of the above applications are incorporated herein by reference.

BACKGROUND OF THE INVENTION

A mass spectrometer is an analytical instrument that separates and detects ions according to their mass-to-charge ratio. Mass spectrometers can be differentiated based on whether trapping or storage of ions is required to enable mass separation and analysis. Non-trapping mass spectrometers do not trap or store ions, and ion densities do not accumulate or build up inside the device prior to mass separation and analysis. Examples in this class are quadrupole mass filters and magnetic sector mass spectrometers in which a high power dynamic electric field or a high power magnetic field, respectively, are used to selectively stabilize the trajectories of ion beams of a single mass-to-charge (m/q) ratio. Trapping spectrometers can be subdivided into two subcategories: dynamic traps, such as, for example, quadrupole ion traps (QIT) and static traps, such as the more recently developed electrostatic confinement traps.

Electrostatic confinement traps include the ion trap disclosed by Ermakov et al. in their PCT/US2007/023834 application that confines ions of different mass-to-charge ratios and kinetic energies within an anharmonic potential well. The ion trap is also provided with a small amplitude AC drive that excites confined ions. The amplitudes of oscillation of the confined ions are increased as their energies increase, due to a coupling between the AC drive frequency and the mass-dependent natural oscillation frequencies of the ions, until the oscillation amplitudes of the ions exceed the physical dimensions of the trap and the mass-selected ions are detected, or the ions fragment or undergo any other physical or chemical transformation.

The electrostatic ion trap disclosed by Ermakov et al. was improved by Brucker et al. in their PCT/US2010/033750 application. The use of anharmonic potentials to confine ions in an oscillatory motion enables much less complex fabrication requirements and much less stringent machining tolerances than are required in harmonic potential electrostatic traps, where strict linear fields are a requirement, because the performance of the trap is not dependent upon a strict or unique functional form for the anharmonic potential. Therefore, mass spectrometry or ion-beam sourcing performance is less sensitive to unit-to-unit variations, allowing more relaxed manufacturing requirements for an anharmonic resonant ion trap mass spectrometer (ART MS) compared to most other mass spectrometers.

SUMMARY OF THE INVENTION

Nevertheless, there remain unit-to-unit variations in the performance of electrostatic ion traps using default ion trap settings. Therefore, a need exists for a method of efficiently and reliably tuning an electrostatic ion trap.

A method of tuning an electrostatic ion trap includes, under automatic electronic control, measuring parameters of the ion trap and adjusting ion trap settings based on the measured parameters. The method can include employing the ion trap settings and producing test spectra from a test gas at a specified pressure.

The trap can include an ion source that can include an electron source, and adjusting ion trap settings can further include adjusting electron source settings. Measuring parameters of the ion trap can include measuring an amount of ions being formed by collisions between electrons and a specified pressure of a test gas as a function of an electron source repeller bias, and adjusting ion trap settings to increase the amount of ions being formed at an electron source filament current, optionally to a maximum of the amount of ions being formed. Measuring parameters of the ion trap can further include measuring an ion initial potential energy distribution (IPED) within the trap at a specified pressure of a test gas. Measuring the IPED can include measuring an IPED onset value.

The trap can further include an ion exit gate having an ion exit gate potential bias, and adjusting ion trap settings can further include providing relative adjustment between an ion initial potential energy distribution (IPED) and the ion exit gate potential bias. Providing relative adjustment between the IPED and the ion exit gate potential bias can include setting the ion exit gate potential bias based on an IPED onset value. Providing relative adjustment between the IPED onset value and the ion exit gate potential bias can further include setting an electron multiplier shield potential bias based on the IPED onset value. Alternatively, providing relative adjustment between the IPED and the ion exit gate potential bias can include adjusting an electron source repeller potential bias and an electron source filament bias to yield a specified IPED onset value.

Measuring parameters of the ion trap can further include measuring a minimum amount of applied RF excitation required to detect an ion signal of a specific ion mass, and measuring the ion signal as a function of applied RF excitation. The method can include setting the RF excitation to an operational RF excitation setting that yields a specified peak ratio of specified peaks in a test spectrum. The specified peak ratio can include a specific value or a range of values. Measuring parameters of the ion trap can also include measuring an ion initial potential energy distribution (IPED) onset value and measuring an ion excited potential energy distribution (EPED) onset value at a test RF excitation setting. The method can include setting the RF excitation to an operational RF excitation setting that yields a specified difference between the EPED and IPED onset values. The specified difference can include a specific value or a range of values. The method can include setting the RF excitation to an operational RF excitation setting that yields a specified spectral resolution. The specified spectral resolution can include a specific value or a range of values. The method can include setting the RF excitation to an operational RF excitation setting that yields a specified dynamic range. The specified dynamic range can include a specific value or a range of values. The method can include setting the RF excitation to an operational RF excitation setting that yields a specified peak ratio of specified peaks in the test spectra, the specified peaks having a specified peak shape. The specified peak ratio can include a specific value or a range of values.

Additionally, an apparatus includes an electrostatic ion trap and electronics configured to measure parameters of the ion trap and configured to adjust ion trap settings based on the measured parameters. The electronics can be configured to perform the method steps described above. The ion trap can include an electron source including a unified electron source and entry slit assembly. The electron source can include an entry slit assembly, including an entry plate having an entry plate potential bias, a filament, and a repeller that forms a beam of electrons from the filament and directs the electrons through the entry slit, the repeller having an extension located between the filament and the entry plate, the repeller shielding the filament from the entry plate potential. The electron source can also include an entry slit assembly having an electrostatic lens located between the filament and the entry slit, the electrostatic lens collimating an electron beam from the filament through the entry slit.

The described methods and apparatus present many advantages, including reducing variation in unit-to-unit performance of electrostatic ion traps.

BRIEF DESCRIPTION OF THE DRAWINGS

The foregoing will be apparent from the following more particular description of example embodiments of the invention, as illustrated in the accompanying drawings in which like reference characters refer to the same parts throughout the different views. The drawings are not necessarily to scale, emphasis instead being placed upon illustrating embodiments of the present invention.

FIG. 16B-1 is a graph of ion charge as a function of applied RF (V) for a 14 amu peak and a 28 amu peak and FIG. 16B-2 is a graph of the 28/14 peak area ratio as a function of RF amplitude.

DETAILED DESCRIPTION OF THE INVENTION

A description of example embodiments of the invention follows.

Figure 1A:
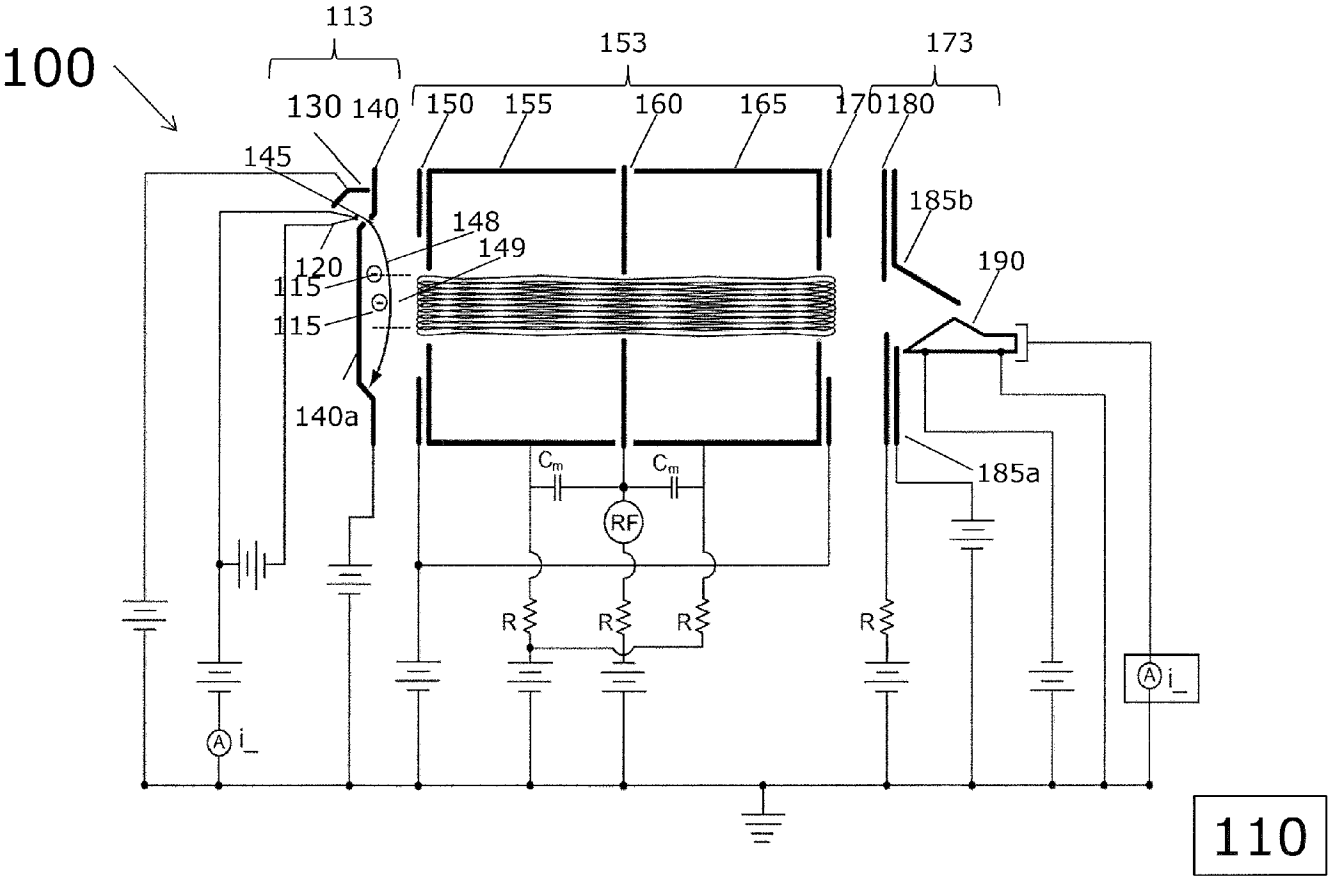
FIG. 1A is a schematic illustration of an electrostatic ion trap.

An example electrostatic ion trap 100 is shown in FIG. 1A. The ion trap 100 includes a controller 110, an ion generation assembly 113, an ion confinement assembly 153, and an ion detection assembly 173. The controller 110 can be a dedicated hardware component, or it can be built in software and operated by a PC as described below. The ion generation assembly 113 includes an electron source 120, shown as a hot filament 120 that generates electrons 115, a repeller 130 that directs the electrons 115 through a slit 145 in entry plate 140, forming a beam of electrons 148 that produces ions in ionization region 149 by electron impact with a gas. The tuning methods described below are also applicable to ion traps employing ion generation by photoionization or external ion generation from another ion source. The ion confinement assembly 153 includes an entry pressure plate 150, an entry cup 155, a transition plate 160, an exit cup 165, and an exit pressure plate 170. The ion detection assembly 173 includes an exit plate 180, an electron multiplier shield plate assembly 185*a* and 185*b*, and an electron multiplier 190 that detects an electron current created by ions impacting the surface of the electron multiplier. The entry and exit plates 140 and 180, entry and exit pressure plates 150 and 170, entry and exit cups 155 and 165, transition plate 160 and electron multiplier shield plate 185*a* are all cylindrically symmetric, with a diameter of about 2.5 cm (1"). The overall length of the electrostatic ion trap 100 is about 5 cm (2"). As shown in FIG. 1A, the entry plate 140 extends outward in a back plane 140*a* in the center away from the entry cup 155. The distance between the entry plate back plane 140*a* and entry cup 155 is about 0.6 cm (0.25"). The distance between the exit cup 165 and the exit plate 180 is also about 0.6 cm (0.25").

Figure 1B:
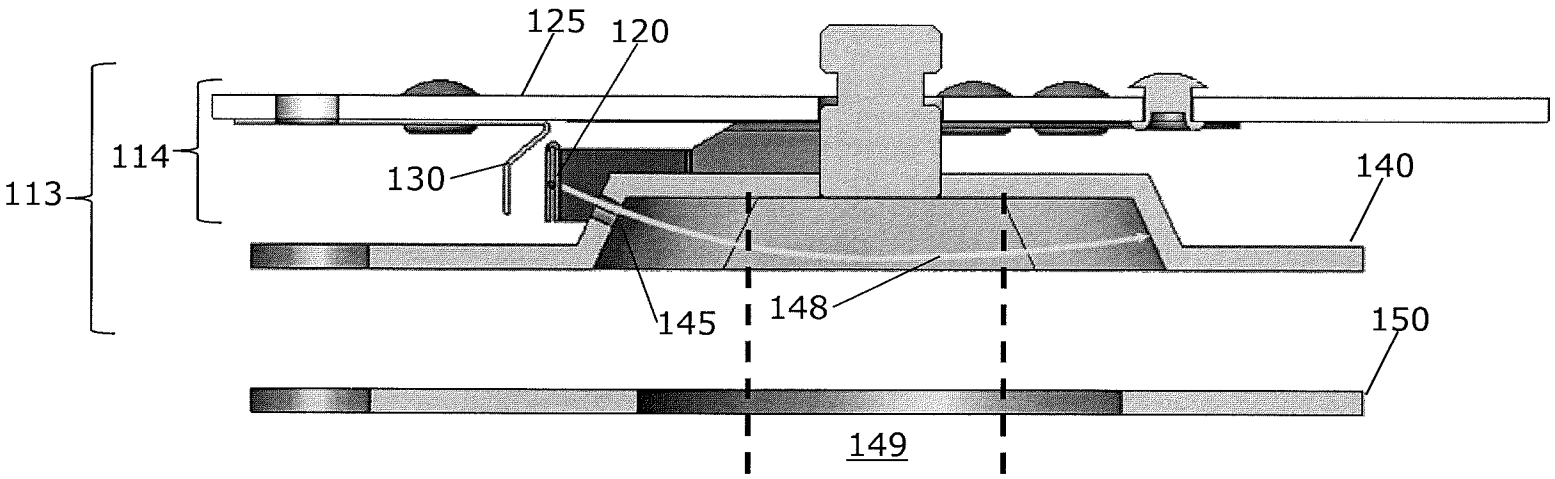
FIG. 1B is a schematic illustration of the electron source assembly of the electrostatic ion trap shown in FIG. 1A.

FIG. 1B shows a side view of the ion generation assembly 113 and the entry pressure plate 150, showing the electron source assembly 114 comprised of the filament 120 and repeller 130 that are attached to an insulator (e.g., ceramic) plate 125, which is attached to the entry plate 140.

During assembly and testing of the electrostatic ion traps shown in FIG. 1A, it was observed that operation of the trap with default settings produced inconsistent performance results. Unit-to-unit variations included changes in amplitude, resolution, dynamic range and even peak ratios from unit to unit, at least in part due to small variations in dimensions of the assembly and small variations in the orientation of the filament 120 and repeller 130 that produced changes in the orientation of the electron beam 148. Variations in performance were also observed after replacement of the electron source assembly 114. As the electron source assembly 114 is a consumable item that is replaced in the field, where certain test fixtures are not readily available, a method of tuning the electrostatic ion trap to obtain consistent performance results needed to be devised that was suitable for both the factory and the field. The tuning process described below requires minimal user input, and does not require a trained service technician.

Figure 2A:
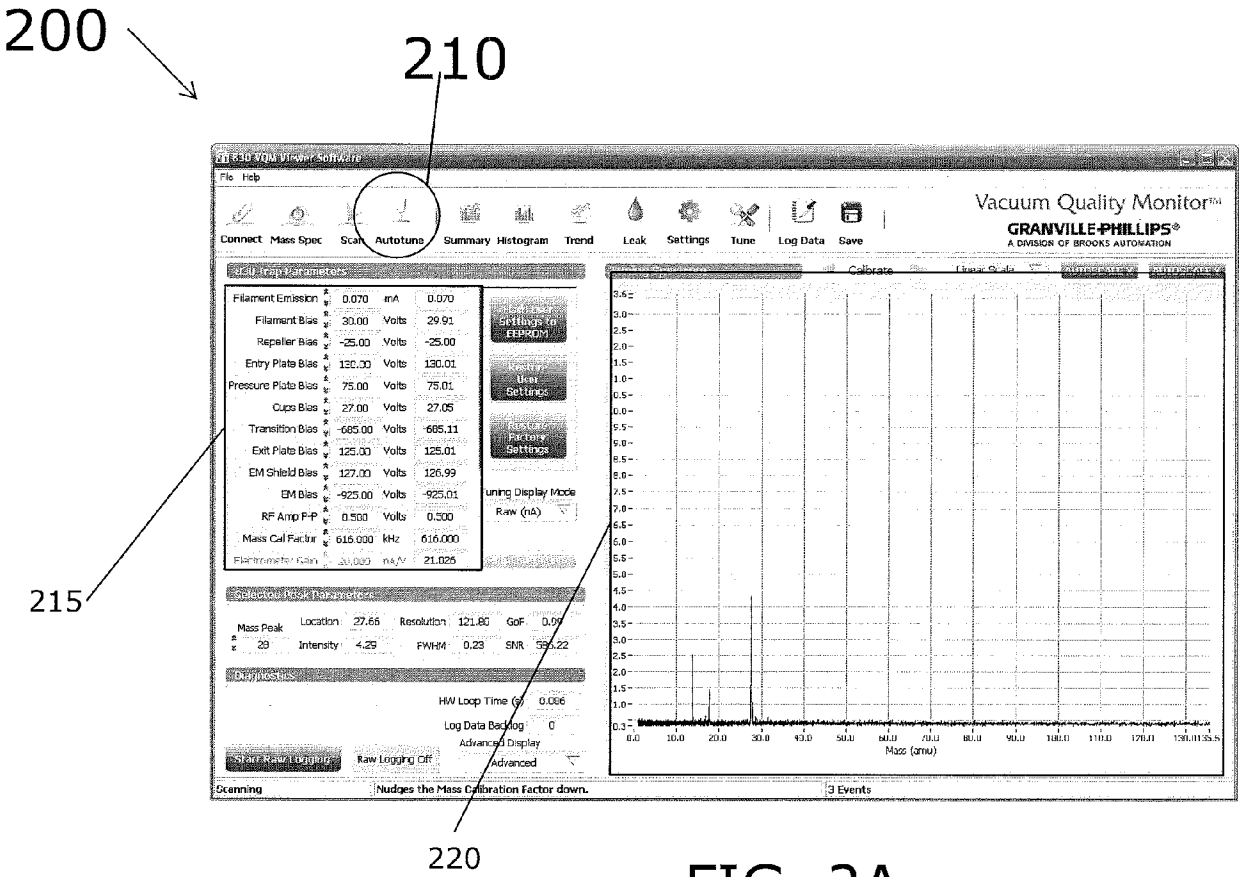
FIG. 2A is a screen shot of the software controller showing a tuning spectrum for the electrostatic ion trap shown in FIG. 1A.

An example of screen 200 of the software that controls the electrostatic ion trap 100 is shown in FIG. 2A, including the autotune software button 210. Control screen 200 also shows the electrostatic ion trap settings 215 that will be described below, and an example tuning spectrum 220. Unless otherwise modified below, the default trap parameters are set according to the values listed in Table 1.

TABLE 1

| Default trap parameters | |
|---|---|
| Filament Emission | 0.070 mA |
| Filament Bias | 30 Volts |
| Repeller Bias | −25 Volts |
| Entry Plate Bias | 130 Volts |
| Entry/Exit Pressure Plate Bias | 75 Volts |

TABLE 1-continued

| Default trap parameters | |
|---|---|
| Entry/Exit Cups Bias | 27 Volts |
| Transition Bias | −685 Volts |
| Exit Plate Bias | 125 Volts |
| EM Shield Bias | 127 Volts |
| EM Bias | −925 Volts |
| RF Amp P-P | 0.5 Volts |
| Mass Cal Factor | 616.5 kHz |

Figure 2B:
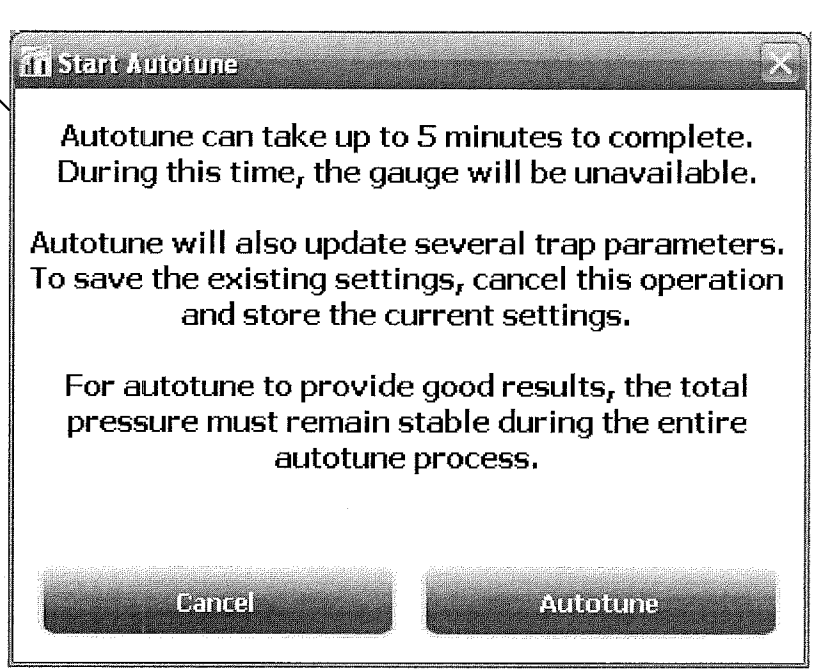
FIG. 2B is a screen shot of the autotune start.
Figure 2C:
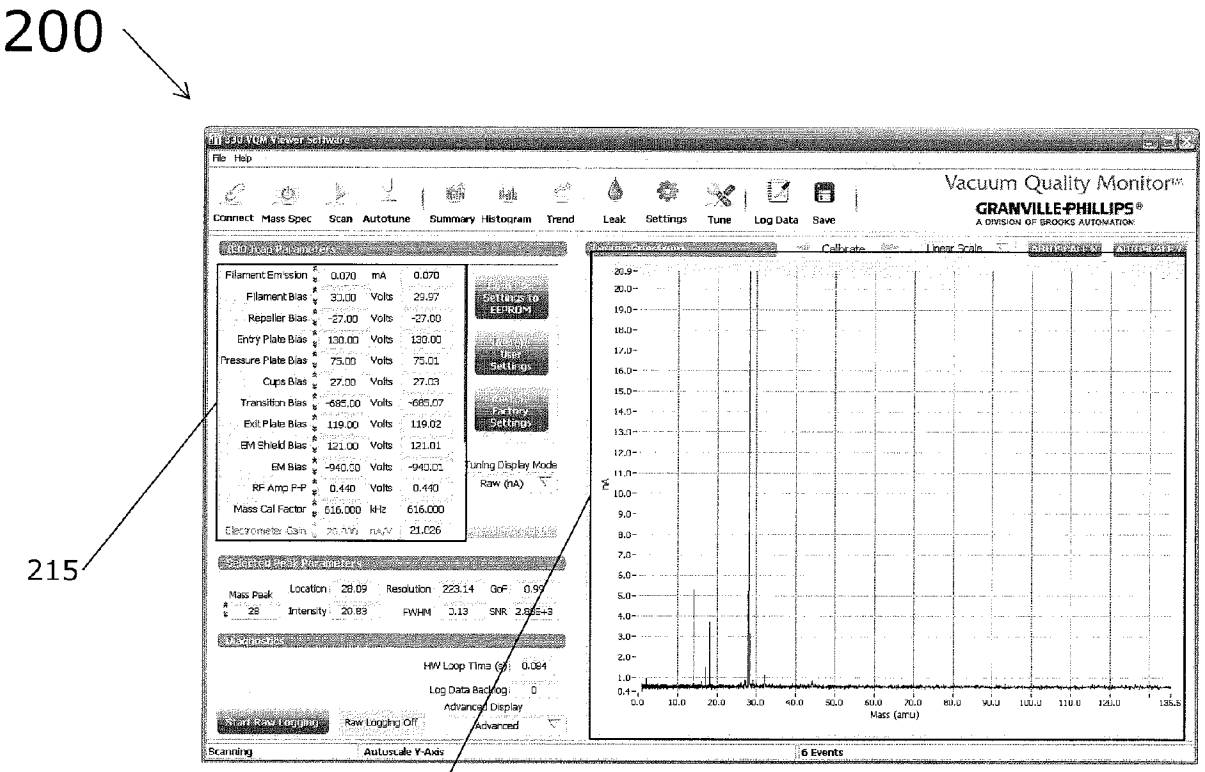
FIG. 2C is a screen shot of the software controller showing an optimized tuning spectrum.

Once a user presses software button 210, a screen 230 shown in FIG. 2B warns the user that the tuning procedure will take some time, during which time the total gas pressure in the ion trap needs to be stable. FIG. 2C shows an example of screen 200 with optimized electrostatic ion trap settings 215 and higher peak amplitudes in tuning spectrum 220 compared to the spectrum shown in FIG. 2A. FIG. 2C also shows that changes in the operational parameters of the trap occurred after the autotune procedure was completed which resulted in the changes in spectral output between FIG. 2A and FIG. 2C. Alternatively, the software can indicate that the ion trap needs to be factory serviced.

The process of qualifying an electrostatic ion trap for use or shipment begins with carefully assembling the ion trap from mechanically inspected parts, and verifying the mechanical assembly. Proper mechanical assembly is required to provide a viable starting point for the autotune procedure, in other words, autotune is not a substitute for proper manufacturing to mechanical tolerance specifications. Then, the ion trap needs to be characterized using the following criteria:

1) are enough ions being made?

2) are the ions being made with the proper initial potential energy distribution?

3) are the ions gaining enough energy from the applied RF excitation?

4) are enough ions being stored in the ion trap?

5) are enough ions ejected per volt of applied RF excitation?

6) is the detector sufficiently sensitive to detect the ejected ions?

Figure 3:
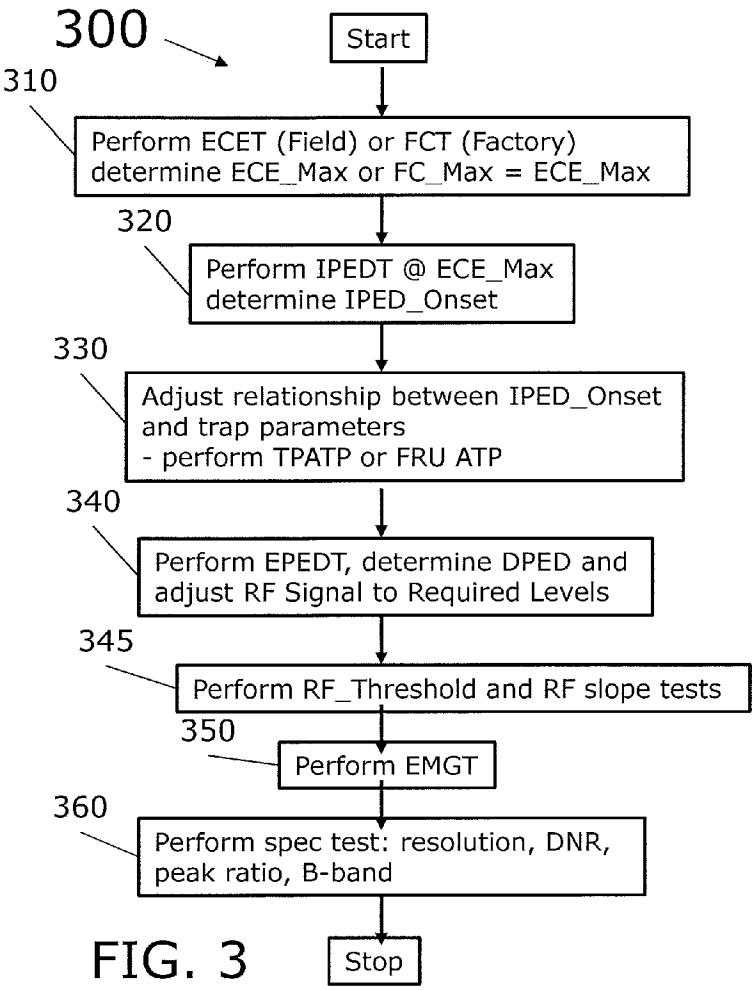
FIG. 3 is a flowchart of the process for tuning the electrostatic ion trap shown in FIG. 1A.

The process of tuning an electrostatic ion trap to compensate for unit-to-unit variability based on these criteria is described below. It is important to realize that even though the tuning procedures described below were specifically optimized for the trap illustrated in FIG. 1A, the same general principles can be applied to tune ion traps in which the ionization region includes an on-axis electron ionization source or a photoionization source. In all cases, the trap operator must characterize the trap based on the criteria previously described, and develop a tailored tuning procedure similar to FIG. 3. As shown in FIG. 3, the process 300 of tuning an electrostatic ion trap to adjust the trap for optimum performance includes: 1) at step 310, adjusting ion trap settings so that enough ions are being formed by providing a maximum electron coupling efficiency (ECE_Max) either in the field (EMECET) or at the factory (FCT), 2) at step 320, ensuring that the formed ions have the proper ion energy distribution by performing an initial potential energy distribution test (IPEDT) at that ECE_Max and determining the IPED onset value, 3) at step 330, ensuring that the proper relationship between the ion initial energy distribution (IPED) and the ion trap parameters is present for all ions formed, either by adjusting the ion trap parameters (TPATP) or by adjusting the IPED (FRUATP), 4) at step 340, ensuring that the proper amount of RF excitation is available to eject the ions by performing an excited potential energy distribution test (EPEDT) and adjusting the difference (DPED) between the excited potential energy distribution (EPED) and the IPED by adjusting the applied RF excitation amplitude, 5) at step 345, measuring the minimum amount of RF amplitude needed to eject ions from the trap (RF Threshold), and the slope of the graph of number of ejected ions as a function of applied RF amplitude (RF Slope), 6), at step 350, ensuring that the proper gain is available at the detector to detect the ejected ions by performing an electron multiplier voltage test (EMVT), and 7) at step 360, ensuring that quality mass spectra are produced by performing spectral quality tests for resolution, dynamic range (DNR), peak ratio, and peak shape (B-band). Tuning steps 310-360 will be sequentially described below, although they can be performed in any order. As also described below, tuning steps 340 and 345 can be performed alternatively or in combination.

Step 310 is described in more detail below and shown in FIG. 4A. The Faraday cup test (FCT) at step 411 is designed to make sure the new trap is capable of making enough ions through electron impact ionization, by measuring the rate of ion formation inside the trap. A proper rate of ion formation is an indication that the FRU and the entry plate are well matched. In other words, the expected rate of ion formation can only be met if the proper alignment is present between the repeller, filament wire and longitudinal slit. The FCT also ensures that a healthy filament coating is present.

Figure 4A:
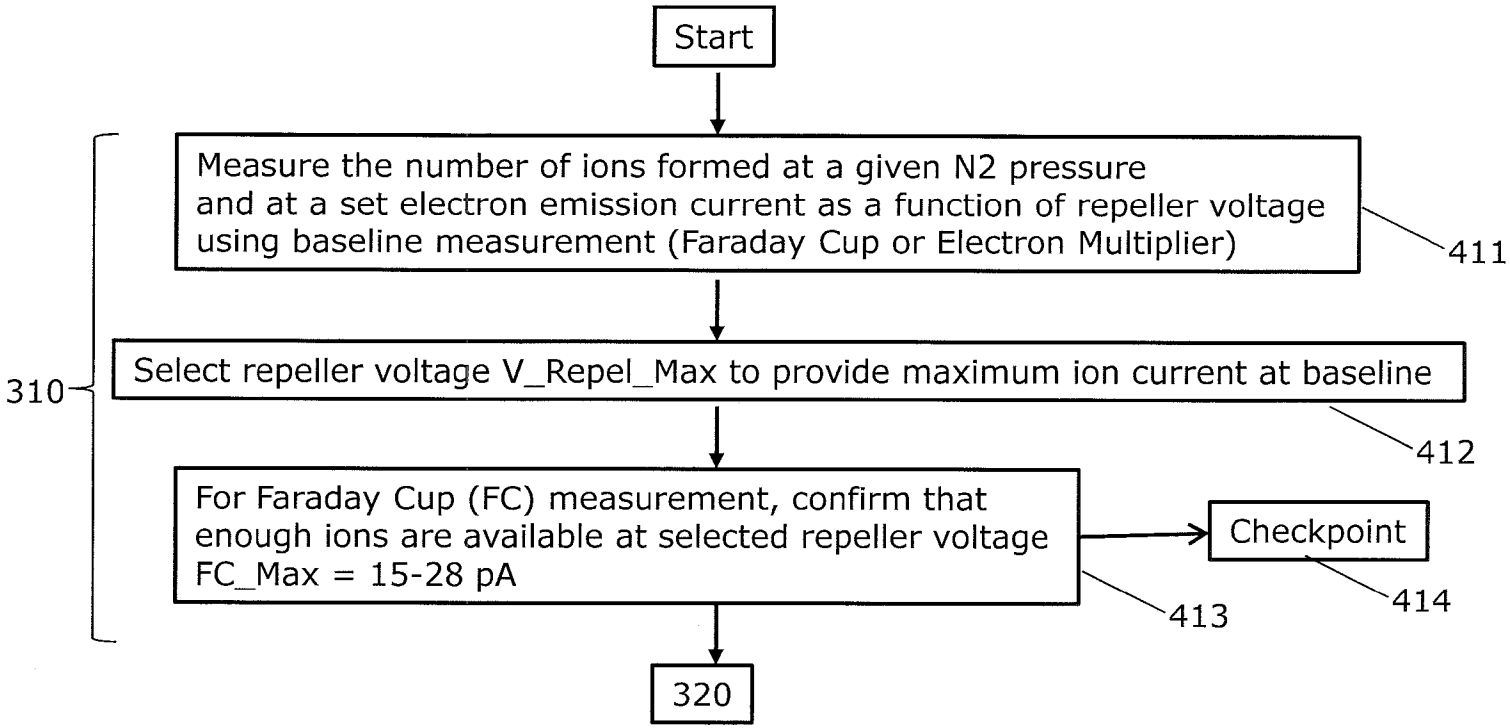
FIG. 4A is a flowchart of step 310 shown in FIG. 3.

Procedure for step 411 shown in FIG. 4A: in order to perform the FCT, the trap is configured as an extractor ionization gauge. The gas in the chamber consists of pure $N_2$ at 2.5E-7 Torr. The trap parameters are set to default values except for the following: the exit plate is set to 70V, and the electron multiplier shield plate is connected to a picoammeter with its input at virtual ground, thereby enabling the plate to act as a Faraday cup. All ions formed inside the trap are allowed to exit the trap without confinement, and the resulting ion current collected at the EM_Shield (Faraday cup) is measured as a function of repeller voltage. As the repeller voltage is scanned over its entire allowable range, the ion current measured at the EM_Shield plate with the picoammeter is recorded as a function of repeller voltage. The two important numbers here are: 1. the repeller voltage, V_Repel_Max, that yields the maximum ion current at the Faraday cup, set at step 412, and 2. the maximum value, FC_Max, of the Faraday cup current determined at step 413. There are expectations for both values: 1. V_Repel_Max must be between −10 and −55V and FC_Max must be between 15 and 28 pA under the test conditions and with the rest of the trap parameters at default settings. The Faraday cup test can be performed by modifying an ion trap controller by connecting the EM_to the virtual ground input of a picoamp level amplifier.

The electron multiplier gain test (EMGT) can be performed next after the FCT described above is completed, as it requires the (V_Repel_Max and FC_Max) values collected during that test, or alternatively, the EMGT can be performed at step 350 as shown in FIG. 3. The purpose of the EMGT is to determine the EM bias voltage required to dial the electron multiplier gain to 1000×. It is important to know the gain of the multiplier in order to know the number of ions ejected from the trap based on EM current measurements.

Figure 4B:
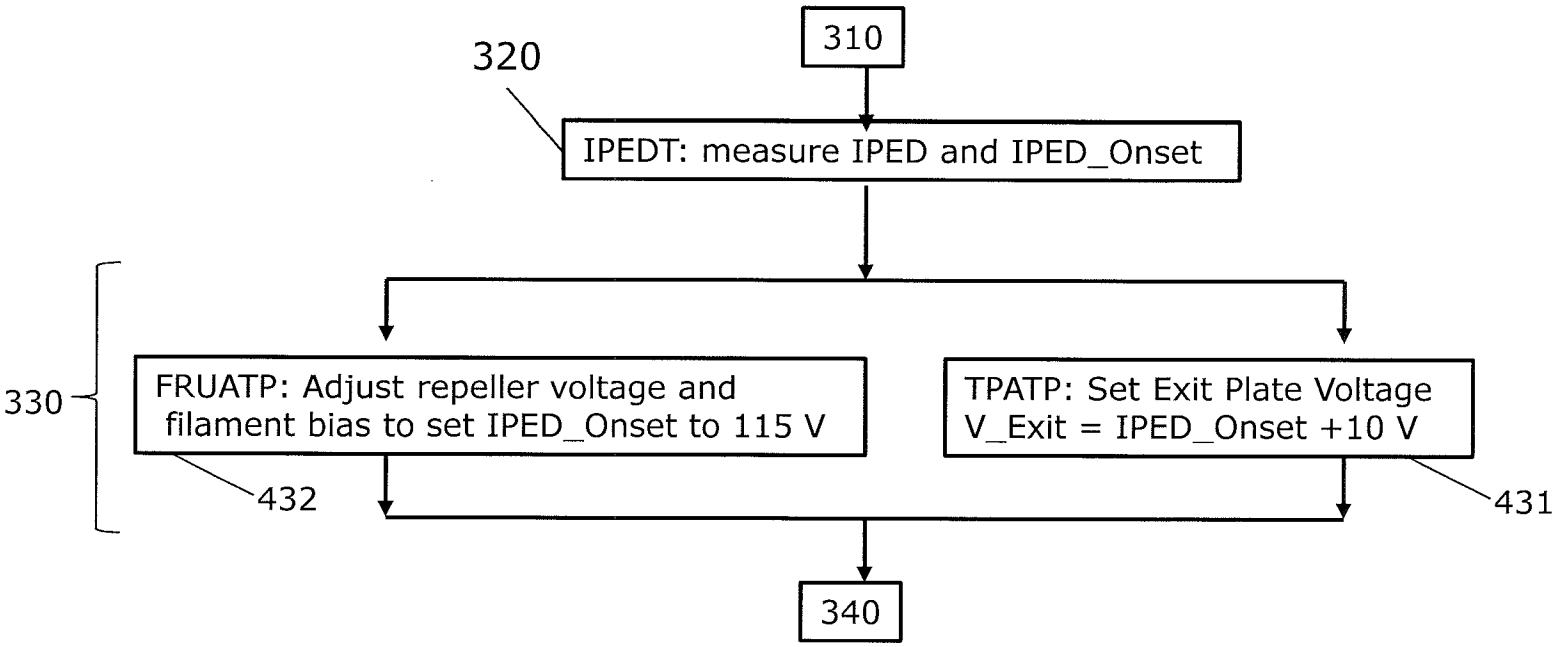
FIG. 4B is a flowchart of steps 320 and 330 shown in FIG. 3.
Figure 4C:
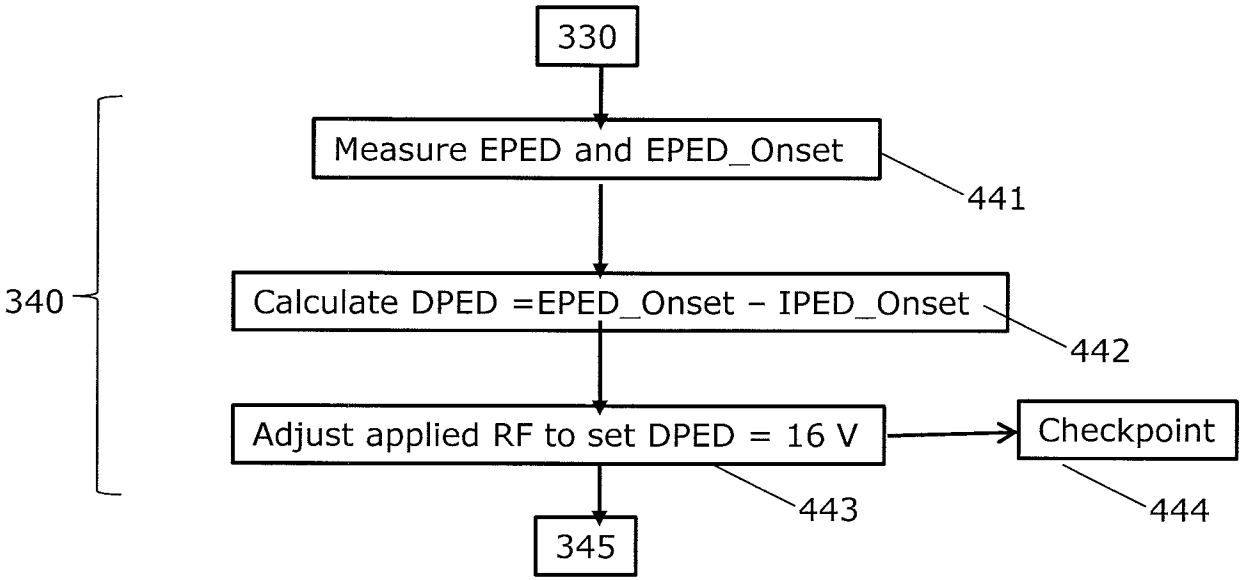
FIG. 4C is a flowchart of step 340 shown in FIG. 3.
Figure 4D:
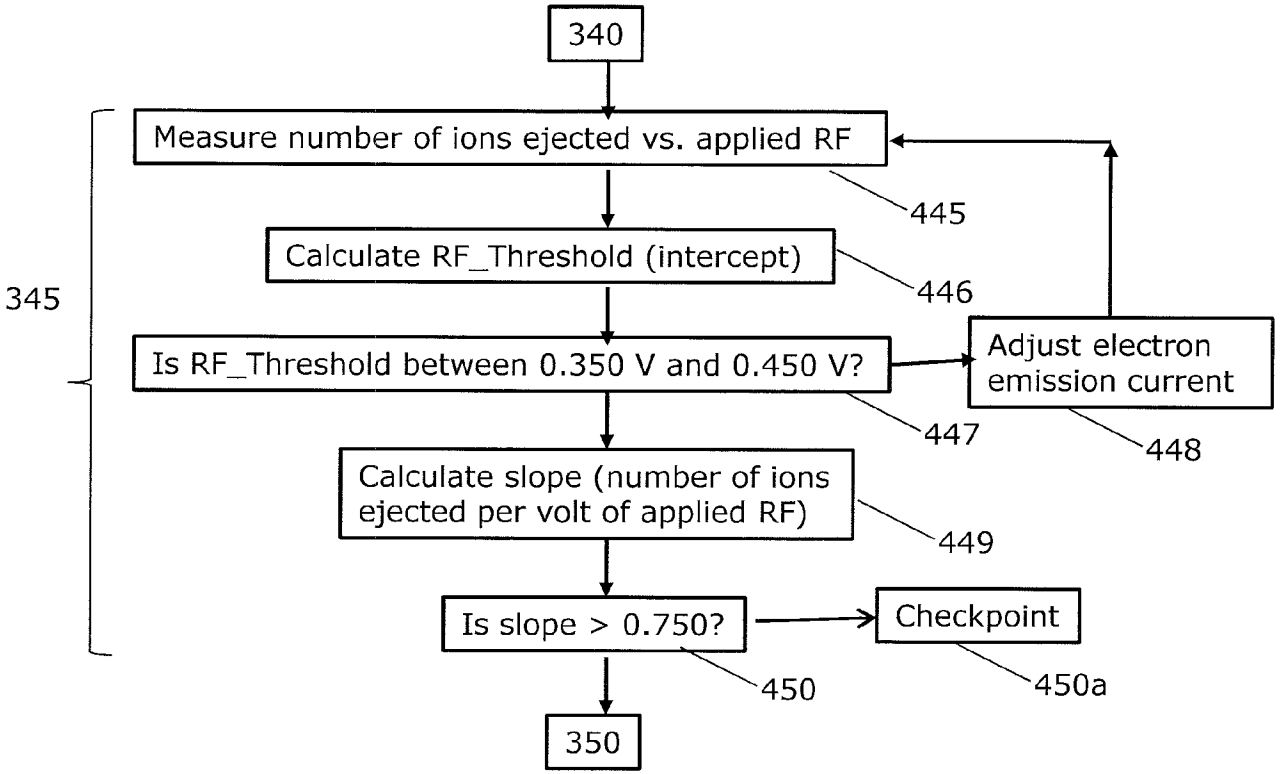
FIG. 4D is a flowchart of step 345 shown in FIG. 3.
Figure 4E:
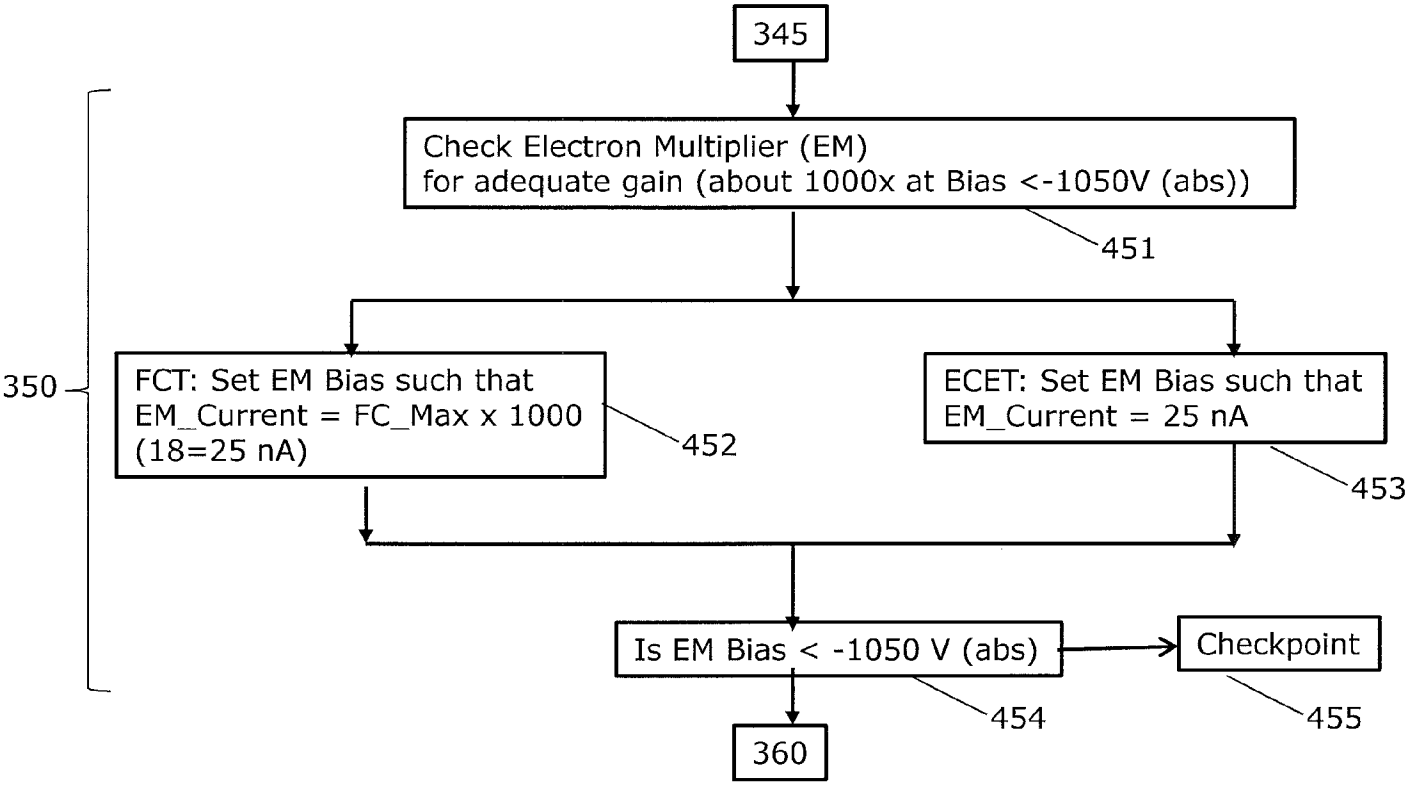
FIG. 4E is a flowchart of step 350 shown in FIG. 3.

Procedure for the EMGT, as shown in steps 451-455 in FIG. 4E:

The EM Gain Test is performed using a standard ion trap controller.

The repeller is set to V_Repel_Max (determined from FCT).

The exit plate is set to 70V.

The EM_Shield is set to 60V.

The EM_Bias voltage is adjusted until the current measured out of the EM is EM_Current=FC_Max*1000.

In general, the electron multiplier devices that are presently available (e.g., manufactured by Detector Technology, Palmer Mass.) typically require an EM_Bias voltage of about −875V. Knowing the gain of the electron multiplier, or operating the ion trap with a known EM gain is important to make quantitative determinations of ion ejection efficiencies. For example, in order to compare RF_Threshold slopes for different traps, the RF_Threshold curves need to be obtained with identical EM gains. Similarly, in order to compare dynamic range between traps, the traps under consideration need to be operated under the same EM gain conditions.

As an alternative to the FCT which is shown as step 452 in FIG. 4E, the electron coupling efficiency test (ECET) at step 453 is designed to optimize the repeller voltage setting and to make sure the maximum possible electron flux is entering the ionization volume. It is very similar to the FCT, but it does not provide a measure of the number of ions made inside the trap. Instead, it only provides a determination of the repeller voltage that leads to the optimal coupling of electrons into the trap's ionization region.

Procedure for the ECET, Shown as Step 453 in FIG. 4E:

1. The chamber is filled with Nitrogen at a pressure of 2.5E-7 Torr.
2. The trap is set to default values except for the different settings noted below.
3. The exit plate is set to 70V.
4. The EM Shield plate is set to 60V.
5. The electron multiplier is set to a gain of roughly 1000.
6. The repeller voltage is scanned from −10 to −55V and the baseline offset amplitude is recorded as a function of the repeller voltage.
7. The Repeller voltage that leads to the largest baseline offset is considered the optimal repeller voltage and used to operate the trap V_repel=ECE_Max.

Steps 320 and 330 are described in more detail below and shown in FIG. 4B. Once the repeller is set to provide the most effective coupling of electrons from the filament and into the ionization region, it is important to understand that making enough ions is critical, but not the only important parameter related to ion formation. The ions have to be made at the proper (i.e., reproducible) rate, but they also have to be made at the right energies within the potential energy curve. The ion trap is capable of ejecting ions generated over a wide range of initial energies; however, the average energy and spread of the energy distribution must be somewhat controlled for consistent performance from unit to unit. The initial potential energy distribution test (IPEDT) is designed to measure the initial potential energies of the ions formed inside the trap, i.e., the potential energies for the ions as they are formed within the trapping potential. Knowing this potential energy distribution is important because it provides a sense of the amount of potential energy each ion will need to acquire in order to reach the exit plate grid, enabling the ion to be ejected.

The IPEDs are important because they are an indication of the amount of energy that the ions formed inside the trap will need to gain in order to reach the exit plate and be ejected. If the ions are made at low energies, then it will take a lot of time to get them to gain enough energy to exit the trap and the ions might not make it to the gate during a fast frequency sweep, and this will lead to low sensitivity. If their energy is too high, then they will start coming out too soon and resolution might be too low to have a useful spectrum.

Once the electron source filament is turned on, and electrons enter the ionization region, the ions start to be formed.

Not all ions will be stored, but those that are stored will likely preserve their initial energies. As one looks at the IPED of the ions formed inside the trap, both the average energy and the shape of the ion energy distribution are important: i.e., the highest energy to be expected, IPED_Onset, and the spread of energies, the full width at half maximum (FWHM) of the IPED. The IPED test is performed in order to determine the IPED_Onset and the IPED FWHM. Since one is generally interested in making as many ions as possible, and since the IPED is affected by the repeller voltage setting, the IPEDT is typically performed with the repeller voltage set to ECE_Max or FC_max.

Procedure for the IPEDT Shown as Step 320 in FIG. 4B:

1. Set pressure to 2.5E-7 Torr of pure nitrogen.
2. Set the ion trap to default settings unless as specified below.
3. Set V_Repel=ECE_Max or FC_Max.
4. Set Exit plate to 132V.
5. Set EM_Shield to 60V.
6. Set EM gain to 1000×.
7. Scan the exit plate voltage V_Exit between 132 V and 70 V, in increments of at least 1V and collect the ion current from the electron multiplier as a function of V_Exit. The data collected in this fashion is plotted in an integrated charge (IC) plot. Note that this is a direct current measurement, i.e., there are no spectral peaks involved.
8. The IPED plot is then generated by differentiating (i.e., calculating the derivative of) the IC curve. The resulting IPED curve provides a measure of the number of ions per volt of V_Exit, and it is a direct representation of the number of ions generated by electron impact per volt of potential energy.
9. The typical IPED distribution is then used to calculate the highest energy onset, that represents the maximum energy that the ions have in the trap as they are formed and subsequently stored. The highest energy onset is known as the IPED_Onset and it is a critical number that must be measured for each gauge.

Figure 8:
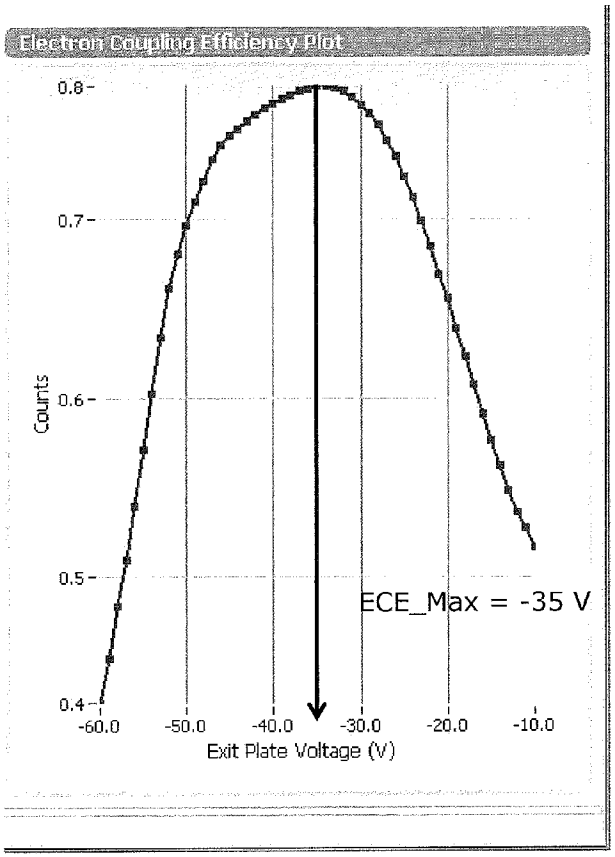
FIG. 8 is a graph of ion current counts as a function of exit plate voltage, showing an ECE_Max equal to −35 V.
Figure 10:
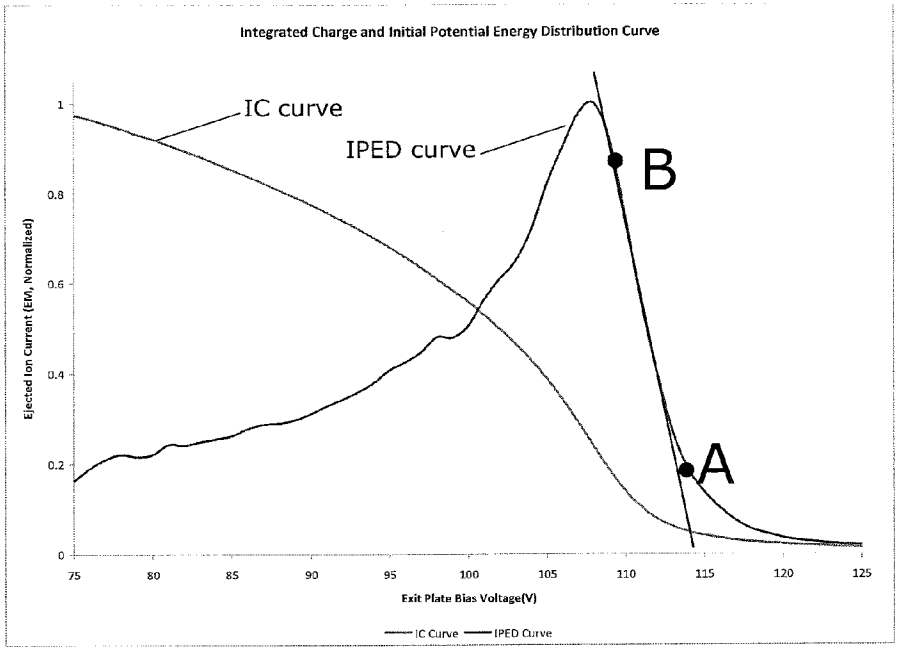
FIG. 10 is a graph of ejected ion current as a function of exit plate bias voltage showing the integrated charge curve shown in FIG. 9 and an IPED curve with a linear fit between points A and B.

FIG. 8 shows a typical ECE_Max and FIG. 10 shows a typical IPED curve. The ECET provides the repeller setting (shown as about −35 V in FIG. 8) required for the IPEDT. The IPED_Onset is a very important number in a trap, as it describes how deep the ions are formed within the trapping potential well. The exact value of the IPED_Onset depends on the alignment between the repeller, filament and slit. In general, the IPED_Onset is expected to be in the range of between about 109 V and about 115V.

Whereas the FCT is a measure of how many ions are being made inside the trap, the IPEDT is a measure of the energy of the ions that are formed inside the trap. Note that this is the energy for the unconfined ions, however, one expects that it also represents the distribution of energies for the stored ions. The data provided by the FCT and the IPEDT is required to characterize the efficiency of ion formation and the ion energetics inside a trap. Without the proper rate of ion formation and without ions having the proper energies, the trap will not perform properly. Controlling ion formation rates and ion energetics is critical for unit-to-unit reproducibility.

Then, as shown at step 431 in FIG. 4B, the IPED_Onset can be used to adjust the exit plate voltage so that the ions have a fixed amount of energy they need to gain in order to be ejected. In general, the exit plate voltage is adjusted to +10V above the IPED_Onset. In other words, all ions have to collect 10V of energy from the RF in order to reach the exit plate wall and exit the trap. Measuring the IPED_Onset and setting V_Exit=IPED_Onset+10V is one way to adjust the trap to the small variations in electron beam position that result from misalignments between the filament, repeller and slit in each trap. In other words, adjusting the exit plate voltage relative to the IPED_Onset compensates electrically for mechanical unit-to-unit variability. The IPEDT is presently part of the autotune procedure used to optimize gauge performance at the factory and in the field.

In addition to knowing the energies at which the ions are formed, it is also important to know the amount of energy those same ions that are stored inside the trap can gain from the RF field during excitation (i.e., during a frequency sweep). Each time a group of ions of a given mass (amu) phaselocks with the RF, the band of energies for those ions is excited to a higher level. Some of the ions in that band reach the exit plate voltage and are ejected from the trap. The excited potential energy distribution test (EPEDT) described in more detail below and shown in FIG. 4C was designed to measure the amount of energy the ions stored in the trap can gain during an RF frequency sweep. Since the exit plate voltage is typically set +10V above the IPED_Onset, the amount of energy gained during an RF sweep must exceed 10 eV in order for the ions to exit the trap through the exit plate grid.

The EPEDT test, shown as steps 441-444 in FIG. 4C, is very similar to the IPEDT. The only difference is that the IPEDT provides the initial energy distribution of the ions as they are created inside the trap, while the EPEDT provides a measure of the amount of energy the ions gain during a sweep. The IPEDT measures a DC current, while the EPEDT measures peak amplitudes. Note that the EPED is also a function of the RF amplitude selected. As expected, the amount of energy gained by the ions will increase as the applied RF amplitude increases. One of the measurements that the EPEDT provides is a confirmation that enough RF amplitude is available to eject the ions out of the trap.

Procedure for the EPEDT shown as steps 441-444 in FIG. 4C:

1. Set vacuum pressure to 2.5E-7 Torr of pure nitrogen.
2. Set the ion trap to default settings unless as specified below.
3. Set V_Repel=ECE_Max or FC_Max.
4. Set V_Exit to 132V.
5. Set EM_Shield to 60V.
6. Set EM gain to 1000×.
7. Set the RF amplitude to the desired value (typically $V_{RF}=0.5\ V_{p\text{-}p}$).
8. Scan the exit plate voltage between 132 and 70V, in increments of at least 1V and collect the peak amplitude (integrated peak charge) at the main peak (or at a selected mass) as a function of V_Exit. The data collected in this fashion is plotted as peak charge vs. V_Exit.
9. The EPEDT curve is typically plotted side by side, next to the IPEDT curve, and the onset for both energy bands is then compared. The difference between both onsets is: DPED=EPED_Onset−IPED_Onset.

Figure 16A:
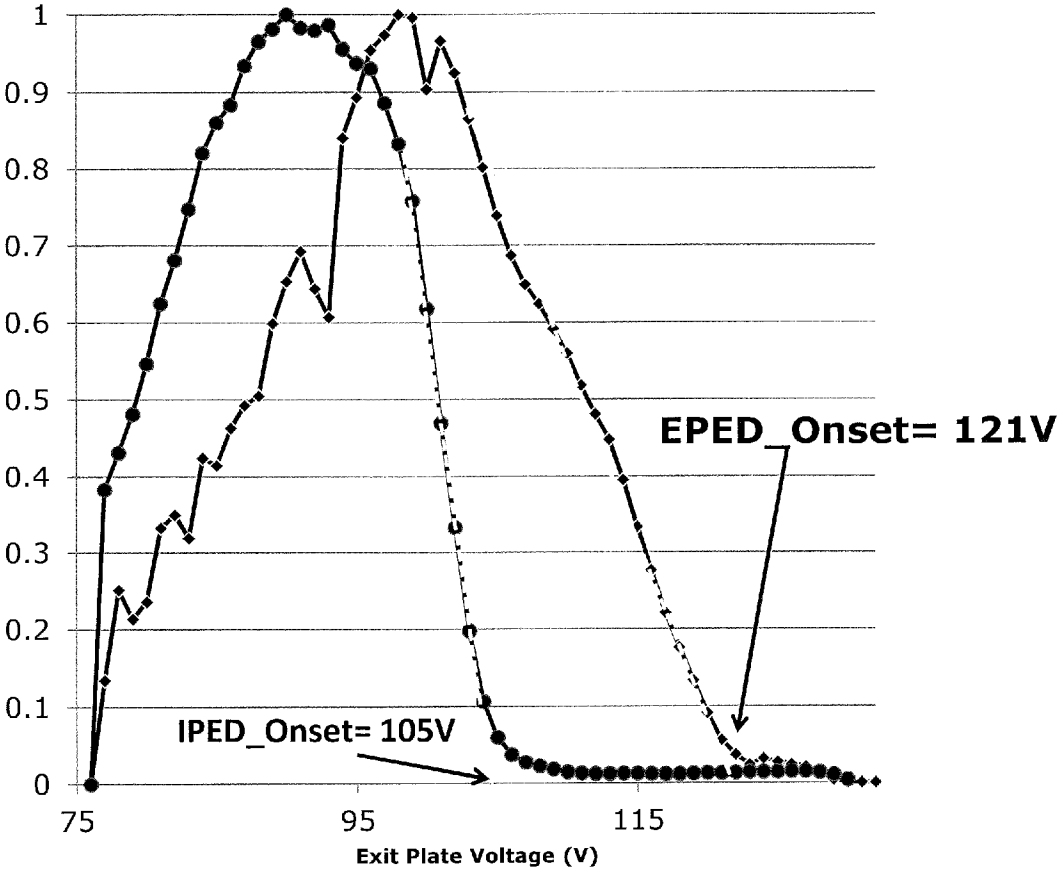
FIG. 16A is a graph of signal as a function of exit plate voltage (V) showing IPED and EPED curves.

FIG. 16A shows an example result of an IPEDT and EPEDT side-by-side with the corresponding onset calculations as well. The difference in energy between the EPED_Onset and the IPED_Onset is dependent on the RF amplitude inside the ion trap. In the example shown in FIG. 16A, IPED_Onset=105 V, EPED_Onset=121 V and DPED=16 V for an RF amplitude of 0.5V.

FIG. 16A shows that as a result of the excitation of the ions in the IPED band, the entire energy band gets energized by about 16 V. Given that the exit plate voltage is set +10V above the IPED_Onset, the result is that the ions have +6 V in excess of the exit plate voltage and should be able to exit the trap. In other words, there is a 6 V band of ions that can exit the trap under these conditions. It has been experimentally determined that the DPED typically reaches a maximum of about 16 V (±3V) with increasing RF amplitude, as shown in FIG.

18. As the RF amplitude increases and the DPED plateau is reached, further increases in RF amplitude do not lead to any additional gain in DPED. The conclusion is that the amount of energy that the ions gain from the RF field is limited to a maximum value, which is believed to be related to (1) the manner in which the RF is distributed amongst the electrode structures and the speed of the RF sweep, in other words, it is possible that a higher DPED value could be achieved with a slower RF scan rate or by applying RF in-phase to the cups and the transition plate. The EPEDT can be used in combination with or can be replaced by the RF_Threshold test described below and shown in FIG. 4D.

The RF_Threshold provides a measure of the number of ions ejected as a function of RF amplitude for the mass peak selected. The x axis intercept (threshold for ejection) is a very important parameter that defines the minimum amount of RF_Amplitude that is required to eject ions from the trap. The RF_Threshold value is routinely used to evaluate ion traps and to confirm that the right number of ions are stored inside the trapping volume. A large deviation in the RF_Threshold value is indicative of poor ion storage capabilities, or poor RF delivery to the trap. Procedure for the RF_Threshold and RF slope tests shown as steps 445-450*a* in FIG. 4D:

1. Set chamber pressure to 2.5E-7 Torr of pure $N_2$.
2. Set V_repel=ECE_Max or FC_Max.
3. Set V_Exit=IPED_Onset+10V.
4. Set gain of the EM to 1000×.
5. Scan RF amplitude from 0.1 to 1V in small increments, measuring the amplitude of the 28 amu peak as a function of RF amplitude at step 445.
6. Calculate the RF_Threshold at step 446 as the x axis intercept, that is, the minimum amount of applied RF required to eject ions. If, at step 447, the RF_Threshold is not in a range between about 0.350 V and about 0.450 V, then, at step 448, adjust electron emission current and recalculate the RF_Threshold. Also, calculate at step 449 the slope to make sure enough ions/Volt are being ejected, providing a measure of the ion ejection efficiency. In a typical ion trap, the RF_Threshold is in a range of between 0.350 V and 0.450 V at step 447, and the slope is greater than 0.75 at step 450.

The RF_Threshold intercept and slope should be known for each trap. If the threshold is low, that generally indicates that not enough ions are stored in the trap. If the trap does not store enough ions, then it will not eject enough ions, and will provide reduced detection limits and a limited dynamic range that does not meet the specifications required for the product. If a trap stores too many ions, then it will more significantly compromise the RF field inside the trap as described below, and the ion trap will not pass the specifications test either. More ions yield a larger RF_Threshold and a steeper slope. However, the trap must have an RF_Threshold and an RF slope that fit within a specified range of values.

One important consideration while performing RF_Threshold determinations is to make sure in advance that a good cable is used to transfer RF from the controller to the trap as the cable is an integral part of the RF network. It is important to check and tune (if necessary) all cables in order to assure consistent RF delivery. RF delivery from the controller to the ion trap requires a cable interconnection. Several cables with different lengths and cable layouts are available. The cable itself is of a complex design, including (1) several different wires used to DC Bias electrodes, as well as (2) a circuit board designed to allow (a) transformer coupling of RF into the high-voltage-biased transition plate as well as (b) simultaneous capacitive coupling into the DC biased entry and exit cups. Each cable presents a 50 Ohm load impedance to the RF source located inside the controller, which assures optimal power transfer from the controller's RF source to the cable. Unfortunately, and depending on the exact cable layout, both the transition plate and cups DC bias wires inside the cable present parasitic capacitances than can load the RF driver and can cause cable-to-cable variations in the amplitude and phase of RF delivered to the sensor electrodes. The most noticeable effect of parasitic capacitances inside the cable is the fact that cable dependent variations in RF_threshold can be noticed unless the cables are tuned at the factory prior to their use.

In order to minimize cable-to-cable variations, a factory cable tuning procedure (CTP) is used for all ion traps. In order to complete a CTP, each cable is compared against a reference cable and tuned to provide identical ion trap performance as compared to the reference cable. The CTP is a catch-all tuning procedure that compensates against subtle variations in phase and amplitude between different cables. The typical tuning steps include:

1. Connect a well characterized ion trap to a calibrated controller using the reference cable.
2. Adjust the RF-Amplitude in the controller to 0.45V and measure the specifications of the system under pure nitrogen gas at 2-3E-7 Torr. Measure and note: resolution, peak heights and peak ratios for the mass peaks at 14 and 28 amu.
3. Replace the reference cable with the cable being tested and repeat the measurements under identical conditions.
4. Compare the specifications for the system with both cables and adjust the load resistor in the cable's circuit board to provide a close match between both sets of specifications. The preferred methodology is to replace the load resistor with a trimming potentiometer and adjust the potentiometer until a match is obtained. Once the match is accomplished, the potentiometer is removed from the boards and its resistance measured. The measured resistance value is then used to select a tuned load resistor value to attach to the cable board.
5. The tuned cable, with the selected load resistor value is then tested one more time to make sure system performance matches that of the reference cable. If a proper match is obtained, the tuned cable is used with that particular ion trap.

The exact procedure described above is just for reference only and represents one of the many different ways in which cable tuning can be accomplished. For example, it is also possible to tune cables by matching the RF_Thresholds of test cables to those of the reference cable. Regardless of the exact methodology selected for CTP, the additional step eliminates cable-to-cable variations from the manufacturing process providing a more consistent product.

Figure 13A:
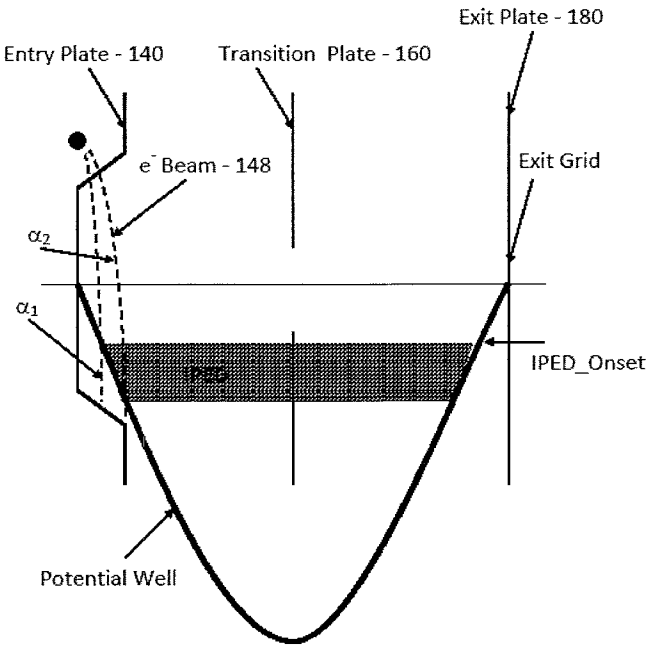
FIG. 13A is a schematic illustration of bands of electrons entering the ion trap with different energies, showing the resulting ion energy band in a potential well inside an electrostatic ion trap.
Figures 1, 13B:
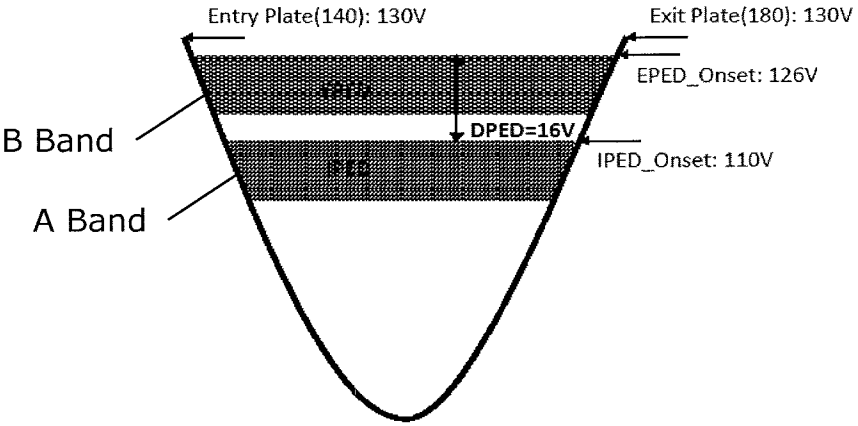
FIGS. 13B-1 and 13B-2 are schematic illustrations of the excitation process for a band ions in a potential well inside an electrostatic ion trap.
Figures 2, 13B:
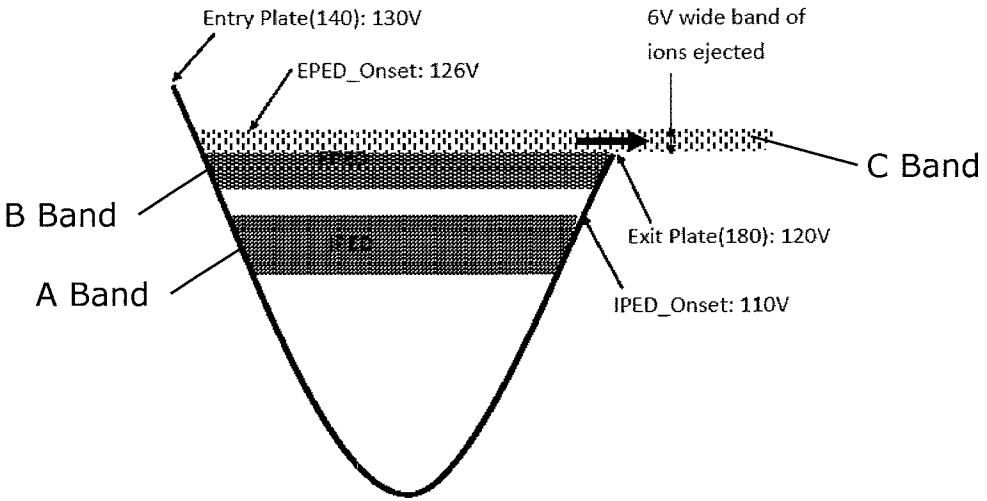
Figures 1, 16B:
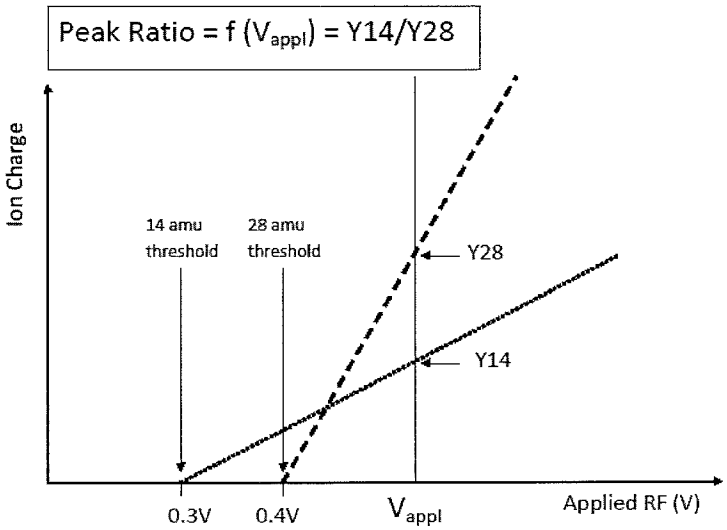
Figures 2, 16B:
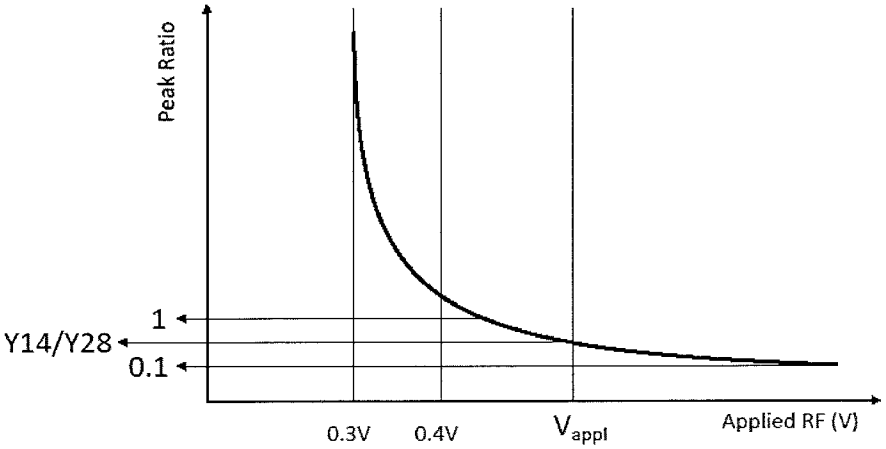

In order for stored ions to gain energy, both the amplitude and phase of the RF delivered to the trap must be controlled throughout the sweep so that all ions are ejected, in other words, there must exist a proper impedance relationship between the RF sweep generator (source) and the trap (load) for power to be effectively delivered to all ions independent of their mass and concentration. Unfortunately, the complex impedance of the trap is related to the number of ions present inside the trap. For example, for pure nitrogen, where most of the ions are formed at 28 amu and fewer ions are formed at 14 amu, one expects that there will be much more RF absorption by the ions at 28 amu than by the ions at 14 amu and that the complex impedance presented by the trap to the RF source will be different for both groups of ions. As the ions phase lock with the RF field, the RF source built into the electronics is responsible for providing proper amplitude and phase to the trap so that ions are ejected. However, due to (1) the finite and fixed source impedance of the RF generator and (2) the changes in trap impedance that occur as ions with different abundances phase lock with the RF, the ejection efficiency of the fixed amplitude RF source depends on the number of ions stored. In general, the ejection efficiency for a specific ion mass diminishes as the number of ions in that group increases, and higher RF amplitudes are always required to eject higher ion concentrations. The electrical analogy of this phenomenon is that as the number of ions in the trap increases, the complex impedance of the trap changes and causes the power transfer from the RF source to the trap (i.e., the load) to become mismatched, so that more RF amplitude is required to make up for the reduced power transfer. The direct consequence of this phenomenon is that the ability of the RF frequency sweep to eject ions depends on the number of those ions stored in the trap. The simplest manifestation of this phenomenon is that the amplitude that needs to be delivered by the RF source to the trap to eject ions increases proportionally with the number of ions stored inside the trap. The key point here is that even though the RF amplitude "applied" to the trap from the controller might be a constant throughout a scan, the RF power available to the ions depends both on the applied RF and on the number of ions stored in the trap. As a result, the RF amplitude at which different species start to be ejected from a trap is proportional to the number of ions stored in the trap. FIG. 16B-1 illustrates this phenomenon, in a trap that includes 14 and 28 amu ions from the ionization of pure nitrogen. The ions at 28 amu are roughly ten times more abundant than the ions at 14 amu. As a result, the ions at 28 amu require more RF amplitude than the ions at 14 amu to be ejected. As shown in FIG. 16B-1, with $N_2$ at 2.5E-7 Torr and the trap at default settings, the ion trap typically starts to eject ions at 14 amu at 0.3V of RF, while the 28 amu ions typically require 0.4V of applied voltage. The graph of the 28/14 ratio as a function of RF amplitude shown in FIG. 16B-2 illustrates the change in peak amplitude at 14 and 28 amu as a function of RF amplitude. As will be explained next, it is the difference in RF thresholds between 14 and 28 amu ions that causes the peak ratio between these ions to be RF amplitude dependent.

Since the more abundant ions at 28 amu require more applied RF to be ejected than the less abundant 14 amu ions, it appears to the casual observer that ions at higher concentrations are somehow depleting the RF field inside the trap requiring more RF amplitude to make up for the apparent loss. As a result, the terminology "RF Depletion" is often used to describe the effect that high ion concentrations have on RF_Thresholds. However, it must be realized that the true root cause for the change in RF_Threshold with ion concentration is the effect that ion concentration has on trap impedance, and how that affects the power transfer from the RF source (i.e., a fixed impedance source).

Since RF_Thresholds are highly dependent on ion concentrations inside the trap in general, an increase in RF_Threshold can be expected when: 1. the gas pressure increases, 2. the emission current increases. This is the reason why RF_Thresholds must always be determined under well established and reproducible conditions to compare unit-to-unit performance. FIG. 16B-1 shows the RF_Threshold curves for the 14 and 28 amu peaks corresponding to pure nitrogen at 2.5E-7 Torr. The solid and dashed lines indicate the number of ions ejected at 14 and 28 amu, respectively, as a function of RF. Since 14 amu is in lower abundance than 28 amu, its ejection threshold (i.e., applied RF amplitude required to start ejecting ions) is lower than it is for 28 amu. In addition, since there are more ions at 28 amu, the slope of the dashed line is also steeper than the slope of the 14 amu line. As expected, the resolving power also decreases with increasing RF. Without wishing to be bound by any particular theory, it is believed that RF depletion inside the ion trap causes different ion masses to be ejected at different RF threshold values, thereby making peak ratios between different ion masses dependent on the applied RF amplitude. In other words, if RF depletion were not a factor, all ions would be ejected at the same RF threshold value independent of their concentration inside the ion trap, and consequently the ratio of peak amplitudes would be independent of applied RF amplitude.

Table 2 illustrates the correlation between RF_Threshold and slope. In all cases, the gauges were operated at ECE_Max, with V_Exit=IPED_Onset+10V, and with the gain of the multiplier set to 1000×.

TABLE 2

Relationship between RF_Threshold and RF slope

| SN# | ECE_Max | FC @ECE_Max | IPED | EM Bias | RF_Threshold | Slope (Ions/volt RF) |
|---|---|---|---|---|---|---|
| 425 | −46 | 1.65 | 113.2 | 844 | 0.405 | 1.33 |
| 416 | −35 | 1.55 | 113.6 | 880 | 0.43 | 1.55 |
| 423 | −32 | 1.49 | 110 | 893 | 0.31 | 0.92 |
| 424 | −21 | 1.42 | 111 | 863 | 0.36 | 1.1 |
| 429 | −31 | 1.43 | 112 | 846 | 0.41 | 1.43 |

Consistent with expectations, Column 2 in Table 2 indicates that there is the standard spread of ECE_Max. The third column is the reading of the SR570 current amplifier at 20 pA/V gain. All five ion traps make similar number of ions inside the trap when the repeller is set at ECE_Max. The fourth column indicates that all traps have acceptable IPED_Onset values. The fifth column indicates that the electron multiplier must be set to a voltage of roughly −865V to provide a gain of 1000×. The last two columns suggest that as the RF_Threshold increases, so does the slope. In fact, there is a fairly linear correlation between the two. This is a very important observation that can be used to diagnose how many ions a trap is able to store. In fact, the value of the RF_Threshold for an optimized ion trap is typically used to diagnose how many ions are stored in the trap and to decide if the product can be shipped. Note that knowing the number of ions stored in the trap and making sure that all traps store the same number of ions and eject the same number of ions per volt of applied RF is an important performance parameter of an ion trap, and it is desirable to have a low variability in this criterion from one ion trap to the next.

Another factor that can affect the RF_Threshold in an ion trap is the difference between the exit plate voltage and the IPED_Onset (V_Exit−IPED_Onset). As the exit plate voltage gets to be further away from the IPED_Onset, the ions need more RF amplitude to exit the trap in the same amount of time, and that causes the RF_Threshold to increase. One can also expect fewer ions to come out as the energy increases, so one expects the slope of the curve to decrease. Table 3 shows results that illustrate the dependence of RF_Threshold on V_Exit.

TABLE 3

| Dependence of RF_Threshold on V_Exit | | | |
|---|---|---|---|
| V_Exit | V_Exit - IPED_Onset | RF_Threshold | Slope |
| 130 | 17 | 0.48 | 0.153 |
| 127.5 | 14.5 | 0.45 | 0.360 |
| 125 | 12 | 0.435 | 0.70 |
| 122.5 | 9.5 | 0.415 | 1.2 |
| 120 | 7 | 0.395 | 1.6 |
| 117.5 | 4.5 | 0.34 | 1.33 |
| 115 | 2 | 0.29 | 1.33 |

As the exit plate voltage gets closer to the IPED_Onset value, the RF_Threshold decreases and the slope increases, because it is easier to eject those ions that have a lower energy hill to climb. The +10V value selected for V_Exit is a good compromise as the slope remains at 1.2 (i.e., an acceptable number of ions are ejected) and the threshold remains around 0.4 V for the 28 amu peak. A slight decrease in V_Exit seems to provide a much better slope value, but a larger baseline would become a problem at higher pressures. As expected, an increase in RF_Threshold is followed by a decrease in the slope, showing that as it gets harder to eject ions relatively fewer are ejected from the trap.

The RF_Threshold also depends on the electron emission current. As the electron emission current increases and more ions are formed inside the trap, the RF_Threshold and slope are expected to increase. Once the trap becomes full of ions, further increases in emission current will have a lower effect on RF_Threshold. Table 4 shows that relationship for $N_2$ at 28 amu and 2.5E-7 Torr pressure.

TABLE 4

| Dependence of RF_Threshold on electron emission current (Ie) | | |
|---|---|---|
| Ie (mA) | RF_Threshold | Slope |
| 0.01 | 0.3 | 0.16 |
| 0.03 | 0.34 | 0.55 |
| 0.05 | 0.39 | 0.90 |
| 0.07 | 0.405 | 1.1 |
| 0.08 | 0.425 | 1.18 |
| 0.10 | 0.445 | 1.20 |
| 0.12 | 0.460 | 1.15 |
| 0.14 | 0.475 | 1.13 |
| 0.16 | 0.475 | 0.93 |

Table 4 suggests that the RF_Threshold increases rapidly as the emission current increases. However, once the default emission current value of 0.07 mA is reached, then the slope is almost at its maximum, meaning that almost all ions that can be ejected are actually ejected. Further increases in emission current cause an increase in RF_Threshold but no further increase in the slope, so that no additional ions are ejected.

The RF_Threshold also depends on the pressure (i.e., gas concentration). As the pressure in the trap increases, more ions are formed and more ions are available to fill the trap and replace ions ejected during scanning. As the pressure increases, the number of ions stored in the trap increases until the trap becomes full. At that point, further increases in pressure should have minimal impact on the RF_Threshold, but should have a substantial impact on the number of ejected ions (i.e., the slope). Table 5 confirms those predictions.

TABLE 5

| Dependence of RF_Threshold on gas pressure | | |
|---|---|---|
| Pressure (Torr) | RF_Threshold | Slope |
| 2.2E−8 | 0.37 | 0.63 |
| 5E−8 | 0.39 | 0.83 |
| 1E−7 | 0.405 | 1.00 |
| 2.5E−7 | 0.42 | 1.08 |
| 5E−7 | 0.425 | 1.08 |
| 1E−6 | 0.42 | 0.93 |
| 2.5E−6 | 0.41 | 0.66 |
| 5E−6 | 0.395 | 0.33 |

Table 5 shows that the RF_Threshold reaches its maximum at a pressure of about 2.5E-7, which is consistent with the trap becoming full at that pressure with 0.07 mA of emission current. Further increases in pressure have minimal effect on the RF_Threshold, meaning that the number of ions stored does not increase above 2.5E-7 Torr. However, the slope also reaches its maximum around 2.5E-7 Torr, but as the pressure continues to increase the number of ejected ions per volt decreases, as the ion neutral scattering collisions make it difficult for ions to exit the trap. This data demonstrates that the ion trap becomes completely filled with ions at about 2.5E-7 Torr of nitrogen. Further increases in pressure do not affect the number of ions stored in the trap (hence the constant RF_Threshold) but will start to affect the ability to eject ions. The data shown in Tables 2-5 indicates that the RF_Threshold tracks the number of ions stored in the trap and that the slope tracks the ion ejection efficiency. Note that the number of unconfined ions also increases with increasing pressure, leading to an increase in the baseline, without a corresponding increase in peak amplitudes, because peak amplitudes are related to the number of ions stored inside the trap, which reach a maximum once the trap is full.

As the pressure increases, the rate of ion formation continues to increase but the number of confined ions reaches a maximum value. Since the baseline offset current is related to the number of unconfined ions, a linear increase in baseline is observed as a function of pressure. Clearly, once the trap is filled to capacity (i.e., 2.5E-7 Torr for Nitrogen) the electron emission current should be reduced to keep a constant and low baseline. The baseline provides a direct measure of the rate of ion formation. Keeping the baseline at a constant value independent of pressure is an excellent way to keep the rate of ion formation a constant at pressures higher than about 2.5E-7 Torr. Additionally, as the pressure increases, V_Exit should be reduced to improve the peak ratios, by reducing the amount of energy the ions must gain to exit the trap. Reducing V_Exit reduces the uphill climb for the ions during excitation and minimizes the chances of losing them to scattering collisions. Increasing RF amplitude is also a good way to make sure the ions gain energy as fast as possible and exit the trap without collisions.

Another embodiment of the tuning process 300 described above is the factory tuning process 500 shown in FIG. 5A that will be described with reference to the components of the electrostatic ion trap 100 shown in FIGS. 1A and 1B. As described above, tuning process 500 includes determining a maximum electron coupling efficiency (ECE_Max) at step 310 that includes steps 510 and 515. At the factory, the ECE_Max is determined by a Faraday cup test (FCT) that measures the electron coupling efficiency (ECE) into the ionization region 149 of the electrostatic ion trap 100. In order to perform the FCT, the electrostatic ion trap is reconfigured electrically to operate as an ion extractor ionization gauge. In this mode of operation, the electron beam 148 produces ions inside the ionization region 149 by electron impact ionization (EII), and the ions are extracted from the trap and collected at the electron multiplier shield (EMS) plate assembly 185*a* and 185*b*. The ion current ejected from the trap is strictly proportional to (a) the electron current coupled into the ionization region 149 and (b) the gas pressure inside the trap, and therefore provides an indirect measure of electron flux into the ionization region. The FCT measures and records extracted ion current (EIC) at a fixed total pressure of pure nitrogen of 2.5E-7 Torr, as a function of the bias, $V_{Repeller}$, on the electron source repeller 130. The effect of adjusting the electron source repeller bias voltage $V_{Repeller}$ is described further below.

In order to configure the trap as an ion extractor gauge: (1) V_Exit on exit plate 180 is set to 70V, (2) the EMS plate assembly 185*a* and 185*b* is connected to ground potential through a sensitive picoammeter, and (3) the electron multiplier 190 is turned off so that every ion formed inside the trap is ejected and collected at the EMS plate assembly 185*a* and 185*b*. The V_Exit is set to 70V so that all ions formed inside the trap are immediately ejected from the trap. The EMS is grounded through a high precision picoammeter, and effectively used as a Faraday cup to provide a measure of ion current.

Figure 6:
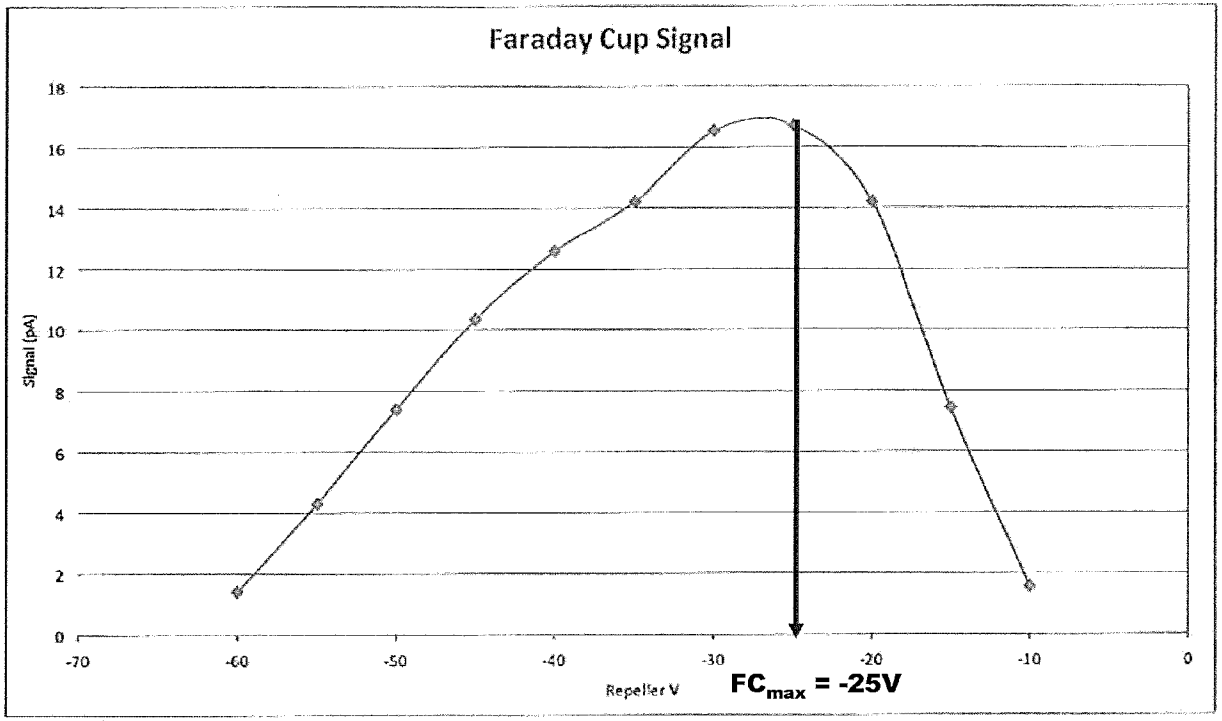
FIG. 6 is a graph of signal as a function of repeller voltage showing an $FC_{max}$ equal to −25 V.

The repeller voltage ($V_{Repeller}$) is varied between −10 and −60V (i.e., over the adjustment range of the electrostatic ion trap controller 110) and the EIC is displayed in units of pA. A typical ion trap will provide a maximum extracted ion current between 15 and 25 pA for some $V_{Repeller}$ between −10 and −60V at a total pressure 2.5E-7 Torr of pure nitrogen. The $V_{Repeller}$ that provides the maximum EIC is called $FC_{max}$ as shown in FIG. 6. The graph shown in FIG. 6 shows the extracted ion current (Signal, pA, Y-axis) vs. $V_{Repeller}$ (Repeller, V, X-axis). The maximum extracted ion current is roughly 17 pA (i.e., between 15 and 25 pA) and corresponds to a $FC_{max}$=−25V. The FCT graph shown in FIG. 6 indicates the maximum ECE occurs at $FC_{max}$=−25V, and that the number of electrons coupled into the trap under those conditions is acceptable, i.e., between 15 and 25 pA for pure $N_2$ at 2.5E-7 Torr.

Figure 7:
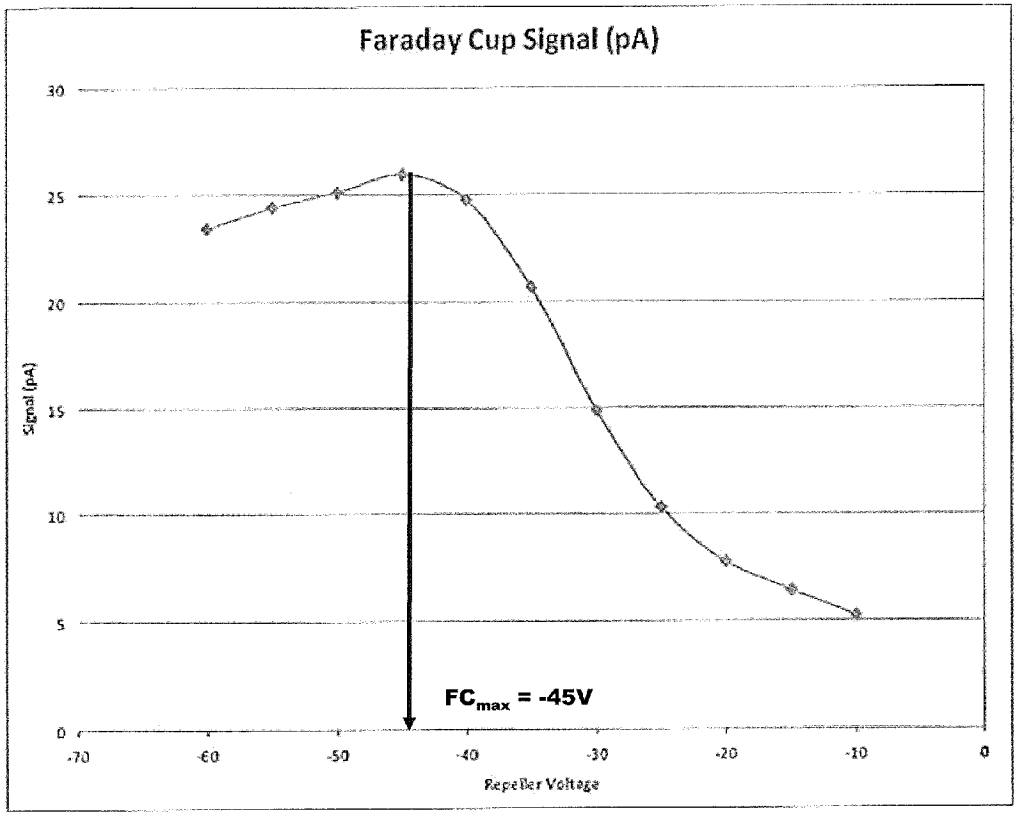
FIG. 7 is a graph of signal as a function of repeller voltage showing an $FC_{max}$ equal to −45 V.

Depending on the specifics of the alignment between repeller/filament/entry slit, the $FC_{max}$ max value will change. FIG. 7 shows an example of a system in which the $FC_{max}$=−45V, where the total pressure was slightly above 2.5E-7 Torr so that the EIC exceeded 25 pA. Electrostatic ion traps typically exhibit FCT curves similar to FIGS. 6 and 7, i.e., typically there is a $V_{Repeller}$ value between −15 and −55 V at which the maximum EIC is between 18 and 25 pA, which is determined at step 515 shown in FIG. 5A.

The FCT is very useful for the qualification of a new electrostatic ion trap because it provides a reliable measurement of the dependence of the electron current on $V_{Repeller}$, and therefore can be used to set the operational $V_{Repeller}$. The EIC depends on the gas pressure (i.e., a fixed quantity) and on the electron current coupled into the ionization volume 149. The electron current coupled into the ionization volume 149 is related to the focusing provided by the repeller 130, and as such depends on $V_{Repeller}$. For the repeller 130/filament 120/entry slit 145 assembly to be acceptable, it must provide a $V_{Repeller}$ value between −15 and −55V at which the extracted ion current is at a maximum, and at which that maximum is between 18 and 25 pA.

If the electrostatic ion trap controller 110 does not include a connection between the electrometer and the EMS plate assembly 185*a* and 185*b*, then an alternative to the FCT that can be performed without any additional equipment (i.e., in the field) is to measure the ion current with the electron multiplier (EM) 190. Measuring the ion current with the electron multiplier 190 provides the ability to measure amplified ion currents very quickly using the electrometer built into the controller 110. However, in this case the amplified ion current amplitude is not an absolute representation of the electron emission, because the gain of the electron multiplier 190 is not generally known, and therefore the electron multiplier electron coupling efficiency test (EMECET) provides trends instead of absolutes, while accomplishing the main goal of determining the $V_{Repeller}$ at which the electron current coupled into the ionization volume 149 reaches its maximum. The expectation is that the amplified EIC will have a maximum, $EMECET_{max}$, at a $V_{Repeller}$ between −15 and −55V, i.e., within the operational limits of the repeller for the electrostatic ion trap controller.

In order to perform the EMECET at step 510 using the electron multiplier 190, the V_Exit is set to 70V, the EMS plate assembly 185*a* and 185*b* voltage is set to 60V, the RF excitation amplitude (RF_Amp) is set to 0V and the $V_{Repeller}$ is scanned between −10 and −60V in small (e.g., steps of about 1 to 2 V) voltage increments, while the output of the electron multiplier 190 is measured, averaged and recorded. At the end of the test, the curve of amplified EIC vs. $V_{Repeller}$ is analyzed, and $EMECET_{max}$, i.e., the $V_{Repeller}$ at which the ion current is at a maximum, is determined. An example of a graph of electron multiplier (EM) counts as a function of exit plate voltage is shown in graph 810 in FIG. 8, where the $EMECET_{max}$ is equal to about −35 V. For a working gauge, the value of $ECE_{max}$ must be between −15 and −55V at step 415. As in the FCT, this test is performed at 2.5E-7 Torr of pure nitrogen gas. In order to avoid ionizer contamination buildup, it is typically required to operate the ion trap at a $V_{Repeller}$ which provides ion currents better than 75% of the maximum current in the curve. This test is performed with the electron multiplier 190 set to a gain in a range of between about 100 times and about 1000 times, while taking care that the output of the electron multiplier 190 is not saturated.

Figure 5A:
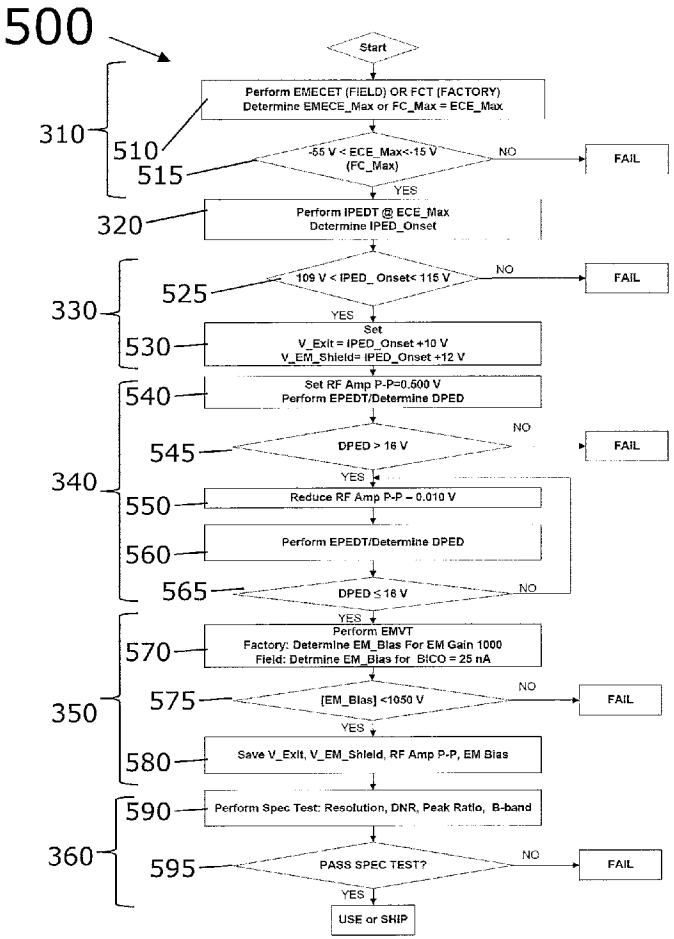
FIG. 5A is a flowchart of the process of tuning the electrostatic ion trap shown in FIG. 1A at the factory and including adjustment of the ion trap settings to match an ion initial potential energy distribution.

As also shown in FIG. 5A, the next step 320 is to measure the ion initial energy distribution (IPED) at the $V_{Repeller}$ which provides the maximum electron coupling efficiency determined above, and to determine the IPED onset value. The IPED test is designed to measure the distribution of initial potential energies for the ions formed inside the electrostatic ion trap with the off-axis ionization source shown in FIGS. 1A and 1B and without any RF excitation. The initial potential energy distribution of ions formed inside the trap depends on (1) alignment between the repeller 130/filament 120/entry slit 145, (2) electron energy (i.e., difference in voltage between $V_{Fil\ Bias}$ and $V_{Entry\ Plate}$) and (3) electron beam focusing (determined by the $V_{Repeller}$ setting). The shape and location of the IPED curve define the operational parameters of the electrostatic ion trap. The IPED test (IPEDT) is performed at 2.5E-7 Torr of pure nitrogen gas. The test is typically performed with the $V_{Repeller}$ set to $ECE_{Max}$ as determined above, but can also be performed at any $V_{Repeller}$ value of choice (i.e., for example while measuring the dependence of IPED on $V_{Repeller}$). The IPEDT provides a direct measurement of the distribution of potential energies for all ions formed inside the ion trap by electron impact ionization and in the absence of any RF excitation.

In order to perform the IPEDT, the trap is configured with mostly default parameter settings except for some changes noted below.

(1) Typically, the $V_{Repeller}$ is set to $V_{Repeller}$=$ECE_{Max}$ (determined from the previous test) so that the energy distributions are determined at the $V_{Repeller}$ that provides the optimal electron coupling efficiency.

(2) The RF_Amp setting is typically set to 0.5V. RF excitation levels will be shown below to have absolutely no impact on IPEDT results.

(3) The EMS plate assembly 185*a* and 185*b* is set to 60V to allow ions to reach the electron multiplier (EM) 190 regardless of the $V_{Exit_Plate}$ used during the scan.

Figure 9:
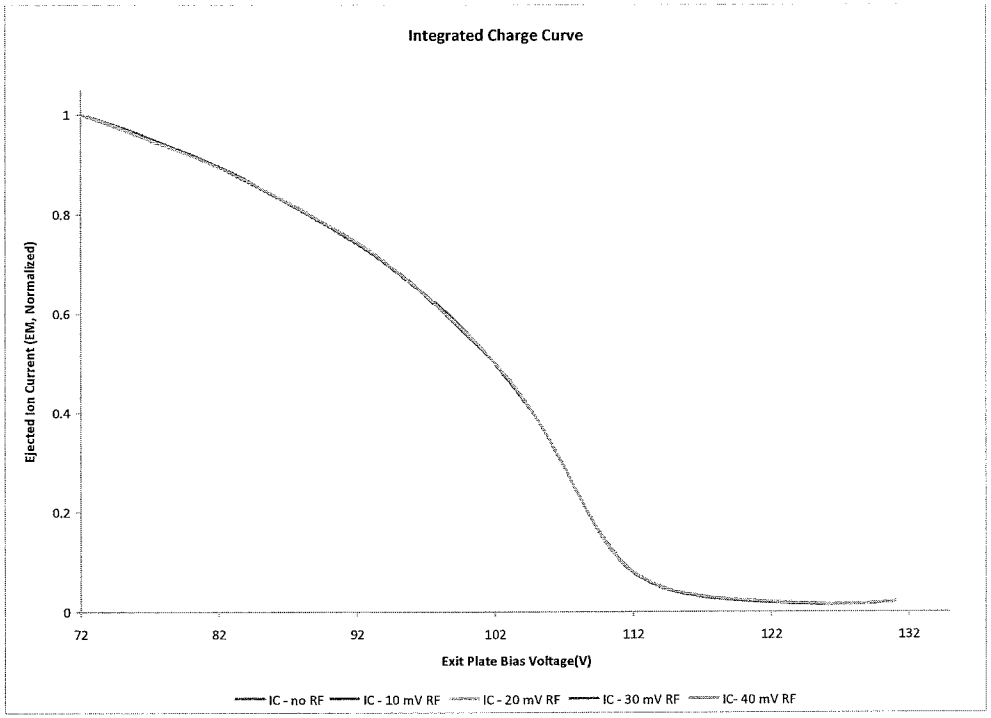
FIG. 9 is a graph of ejected ion current as a function of exit plate bias voltage showing an integrated charge (IC) curve.

During the IPEDT, the V_Exit is stepped down in small increments (i.e., 1-5 V increments), starting from a voltage above the V_Entry_Plate (i.e., typically starting at V_Exit=132 V) and reaching beyond the bias voltage on entry pressure plate 150 (i.e., typically ending at V_Exit=75 V). For each voltage step, the baseline signal from the EM 190 is measured, averaged and recorded vs. V_Exit. The baseline ion current offset (BICO) is measured by averaging all data points collected between 1.2 amu and 1.7 amu (i.e., in any mass range where there are no ions in the trap) during a standard scan while using nitrogen gas flow to maintain a total pressure of 2.5E-7 Torr. The baseline can be measured anywhere there are no actual mass peaks in the spectrum, such as between 21 amu and 25 amu. The resulting curve of baseline current vs. V_Exit is the integrated charge (IC) curve and tracks the increase in ejected ion current as the V_Exit is lowered. A typical IC curve is shown in FIG. 9.

As the V_Exit starts to decrease (i.e., moving to the left in the x axis in FIG. 9), the exit plate 180 starts to approach the initial potential energy of the ions stored inside the trap. As the V_Exit reaches about 115 V, the potential bias of the exit plate 180 reaches the upper potential energy of the stored ions, and any further decrease in V_Exit results in ions exiting the trap through the transparent mesh of the exit plate 180, i.e., only ions with initial potential energies below the V_Exit can be stored in the trap. With each further decrease in V_Exit, additional ions are ejected from the trap, i.e., the range of energies stored is smaller and the baseline current is larger. The increase in baseline offset signal that takes place with each decrease in V_Exit is a measure of the number of additional ions that are ejected from the trap as the voltage step takes place, and is also proportional to the number of ions that are stored in the trap between the two potential energies spanned by the potential step. As expected, the baseline continues to increase as the V_Exit continues to decrease, and fewer ions can be stored in the trap. The baseline ion signal (i.e., ejected ion current) at any given exit plate voltage in the IC curve is proportional to the integration of the number of ions stored inside the trap with initial potential energies above the V_Exit. In FIG. 9, the upper potential energy for the ions stored inside the trap is about 115V, indicating that all ions formed by the electron beam 148 can be stored inside the trap, given that the default V_Exit is 125 V, that is, 10 V higher than the highest initial potential energy (IPED_Onset=115V). As shown in FIG. 9, the IC curve continues to integrate the ion charge up to 72 V in the $V_{Exit_Plate}$. The IC curve is independent of the RF signal delivered into the ion trap during the IPEDT scan. As shown in FIG. 9, the IC curve was repeated with applied RF amplitudes (peak-to-peak) ($RF_{_AMP}$ P-P) corresponding to 0, 10, 20, 30 and 40 mV of RF signal delivered into the ion trap, and no discernable difference was observed in the curves, demonstrating that RF excitation has no impact on the baseline ion current.

In other words, the IC curve is an excellent way to represent IC as a function of potential energy. For example, the signal at 92 V is proportional to the IC stored inside the trap during normal operation with initial potential energies between 115 V and 92 V. Once the IC curve is generated, the IPED_Onset value for the trap is measured by determining the onset of the IC curve. In FIG. 9, the onset of the baseline ion current offset is about 115V, and that value corresponds to the IPED_Onset for the ions stored inside the trap. The determination of the IPED_Onset can be performed in many ways. One approach that provides a visualization of the actual distribution of ion population as a function of potential energy is to calculate the derivative of the IC curve, shown in FIG. 10, which is defined as the initial potential energy distribution (IPED) curve. FIG. 10 shows both the IC and IPED curves for a typical electrostatic ion trap. The IPED curve can be used to directly visualize the distribution of ion population at different IPE values. The IPED curve indicates that the IPED_Onset for the trap is about 115V and that the highest concentration of ions has a potential energy of about 110V. The IPED curve provides a sharper onset and a much more reliable way to determine the IPED_Onset for the ions stored in the trap than the IC curve. One approach to determining the onset of the IPED curve (i.e., the IPED_Onset) uses a linear fit between two points A and B that equal 10% and 90%, respectively, of the maximum amplitude on the high voltage side of the IPED curve, as shown in FIG. 10.

Figure 5B:
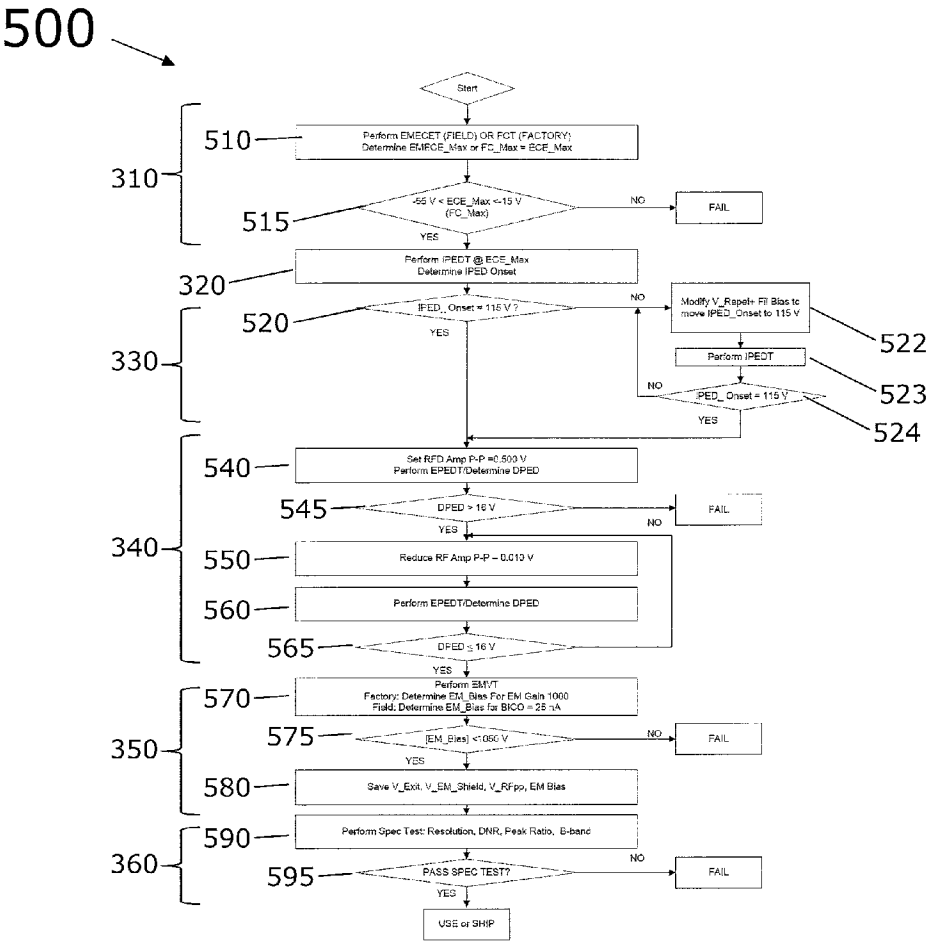
FIG. 5B is a flowchart of the process of tuning the electrostatic ion trap shown in FIG. 1A at the factory and including adjustment of the ion initial potential energy distribution to match the ion trap settings.

Once the IPED_Onset is measured as described above, relative adjustment is provided at step 330 between the IPED_Onset value and the ion trap settings as shown in FIG. 4B, either by adjusting the ion trap settings at step 440, and shown in detail in FIG. 5A, or by adjusting the IPED onset value at step 450, and shown in detail in FIG. 5B. FIGS. 5A and 5B each show the entire factory tuning process 500, with the only difference between FIG. 5A and FIG. 5B consisting of the details of step 330, which are shown in the respective figures and described below. Adjustment of the ion trap settings is the preferred tuning process at the factory at present.

Turning back to FIG. 5A, at step 515, $V_{Repeller}$=$ECE_{Max}$ should be in a range of between about −55 V and about −15 V. At step 320, the IPED_Onset value is measured at the previously determined ECE_Max as described above, and, at step 525, if the IPED_Onset is in a range of between about 109 V and about 115 V, then, at step 530, the exit plate potential bias, V_Exit, is set at V_Exit=IPED_Onset+10 V, and the electron multiplier shield plate potential bias, $V_{EMS}$, is set at $V_{EMS}$=IPED_Onset+12 V.

Alternatively, as discussed above, the IPED_Onset can be modified as shown in FIG. 5B. After the same steps 310 and 320 described above, a determination is made at step 520 whether the IPED_Onset is equal to a specified IPED_Onset (e.g., about 115 V). If not, then, at step 522, a combination of electron energy adjustment and electron beam focusing by adjustment of $V_{Repeller}$ and filament bias ($V_{Fil_Bias}$) on filament 120 should be able to adjust how many electrons go into the trap and where the electrons cross the potential energy curve to form ions to produce an IPED_Onset which is recursively measured at step 523 and compared to a specified IPED_Onset at step 524.

Figure 11:
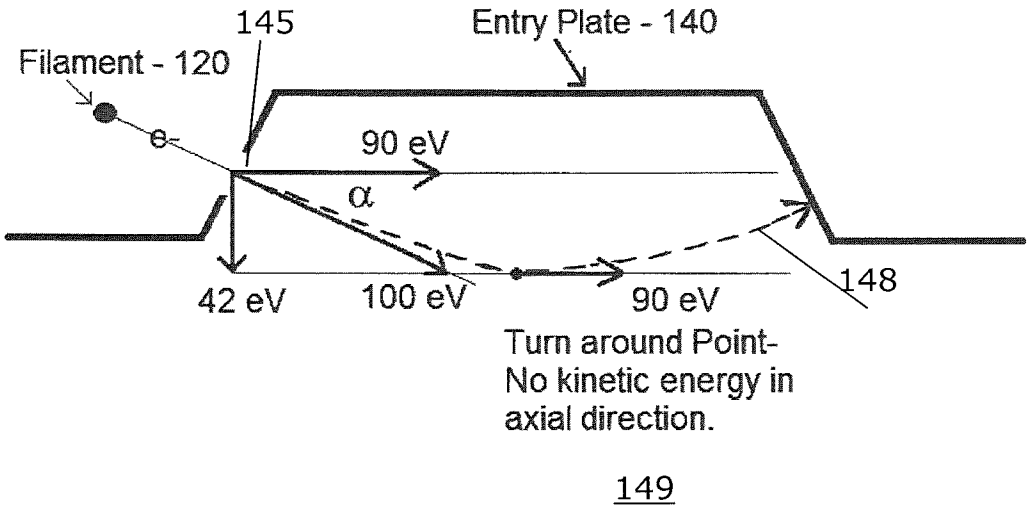
FIG. 11 is a schematic illustration of energies of electrons entering the ion trap.
Figure 12:
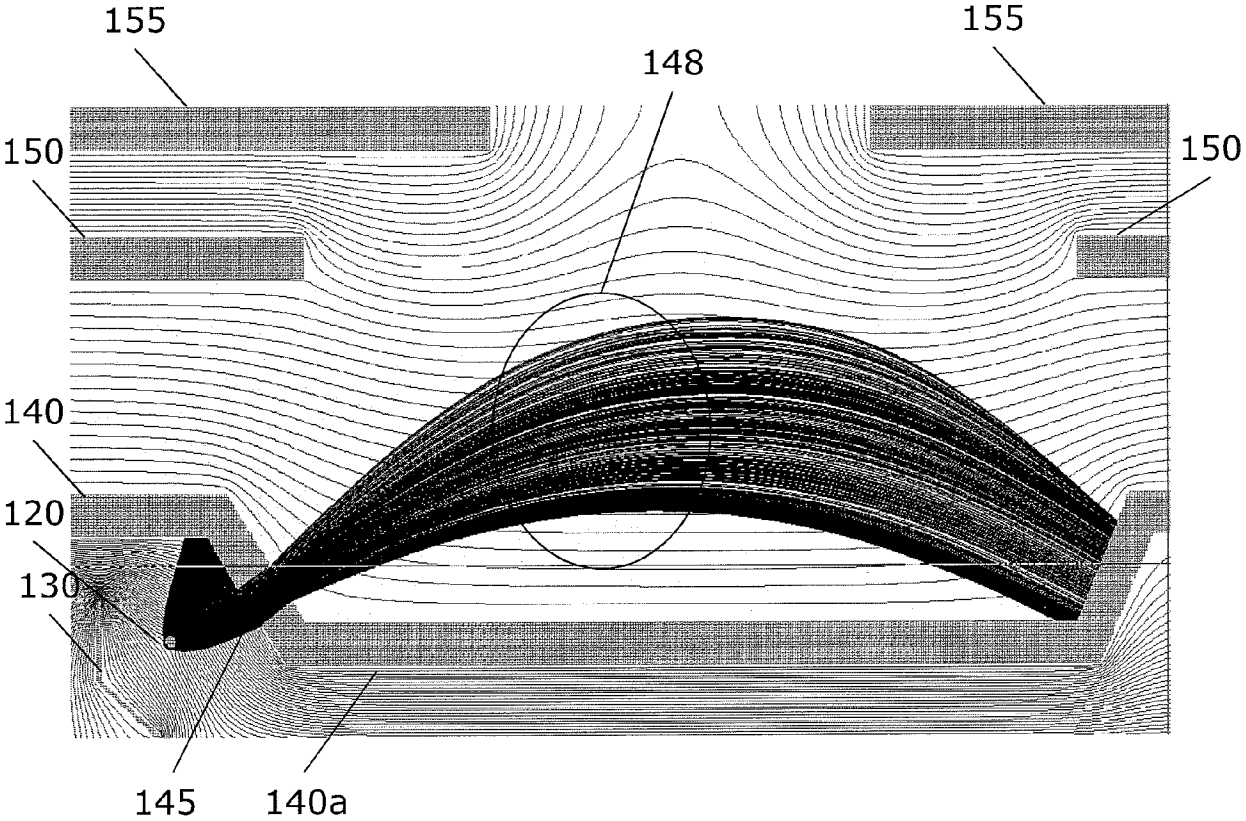
FIG. 12 is a schematic illustration of bands of electrons entering the ion trap with different energies.

Electron trajectory through the ionization region 149 is determined by the combination of (1) alignment between repeller 130/filament 120/entry slit 145, (2) the focusing field required to most efficiently couple the electron beam 148 into the ionization region 149 and (3) the kinetic energy of the electrons as they enter the ionization region 149. Efficient coupling of the electrons into the entry slit requires measuring $ECE_{max}$ through the FCT or the EMECET methodologies described above. If the $V_{Fil_Bias}$ is changed (i.e., in order to change electron energy), the $ECE_{Max}$ is restored by preserving the difference ($V_{Fil_Bias}$−$V_{Repeller}$). The kinetic energy of the electrons as they enter the ionization region 149 is defined as a voltage difference: electron energy EE=$V_{Entry\ Plate}$−$V_{Fil_Bias}$. For a typical electrostatic ion trap, the default kinetic energy for the electrons is 100 eV (EE=130 V−30 V). FIGS. 11, 12, 13A, 13B-1, and 13B-2 show schematic representations of the energetics of electrons entering the trap. As shown in FIG. 11, the turn-around point for an electron depends both on the initial kinetic energy (IKE) of the electron as well as the angle, a, of the electron beam: IKE= $V_{Entry_Plate}-V_{Fil_Bias}$, i.e., the energy of the electron depends on the difference in voltage between the entry plate 140 and the filament 120. The electron beam angle α shown in FIG. 10 is defined by the alignment between repeller 130/filament 120/entry slit 145 and by the difference in voltage between $V_{Fil_Bias}$ and $V_{Repeller}$ that leads to the most efficient ECE (i.e., $ECE_{max}$). A typical value of α is about 25° (±10°). Electrons enter the ionization region 149 with a distribution of angles α leading to the final IPED for the trap, as shown in FIG. 13A.

Figure 14:
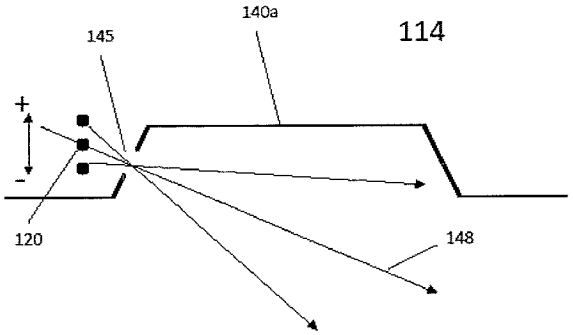
FIG. 14 is a schematic illustration of the effects of electron beam displacement.

For an electron entering the trap with 100 eV of IKE (i.e., the default IKE for a typical electrostatic ion trap), and α=25°, the turn around point is reached when the electrons climb 42 V in the trap's potential energy curve along the axis. In order to increase the depth of the turn-around point within the trap's potential, the user can increase the IKE or change the angle α. Increasing the IKE is generally done by decreasing $V_{Fil_Bias}$, and changing $V_{Repeller}$ to preserve coupling efficiency. As shown in FIG. 13A, the electrons in the ion beam enter the trap with a distribution of α angles ($\alpha_1$-$\alpha_2$ in FIG. 13A), leading to a band of IPED. The shape and location of the band is controlled by the adjustments described above. FIG. 14 shows the effect of moving the filament 120 up or down within the field replaceable unit (FRU) 114 that holds the repeller 130 and the filament 120. If the filament 120 is placed high relative to the slit 145 (+displacement), the electron beam 148 is pushed further into the trap causing the IPED_Onset to decrease and the IPED band to shift to lower energies. This results in lower ejection efficiencies for the ions, and in an increase in RF_Threshold that affects peak ratios and increases resolution as the ejection thresholds increase. If the filament 120 is placed low relative to the slit 145 (−displacement), the electron beam 148 is displaced towards the entry plate 140, and the ejection threshold for the ions decreases. Reduced ejection thresholds result in higher peak amplitudes, reduced resolution, and increased baseline offset levels. This type of misalignment often produces peaks with poor peak shape, relative to a desired Gaussian peak shape. The ideal IPE distribution curve has its maximum energy onset in a range of between about 109 V and about 115 V. For maximum resolution and highest dynamic range, the width of the energy distribution should be as narrow as possible. Operating the ion trap using the $V_{Repeller}$ set to $ECE_{Max}$ as described above typically results in narrow ion energy distributions. A high IPED_Onset that does not exceed the exit plate voltage assures high signal levels with low baseline offset. The narrow energy distribution assures high resolution and dynamic range. As shown in FIG. 10, typical examples of the IPED curves observed in electrostatic ion traps have a maximum in a range of between about 100 V and about 120V and have a minimum energy in a range of between about 70 V and about 85 V.

FIGS. 13B-1 and 13B-2 illustrate what is believed to be the typical energy pumping process in a trap operated above the x axis intercept of the RF_Threshold curve. The A band represents the energy spread for the ions as formed and stored. The B band is the same band but excited by an amount of RF that excites the ions by 16V (i.e., the typical maximum value in examplary ion traps). FIG. 13B-1 shows an IPED_Onset of 110V, while the EPED_Onset is 126V. The entire band is lifted and pumped by 16V. In this ion trap, the exit plate voltage is set to IPED_Onset+10V=120V, while the ions are capable of reaching 126V after excitation. As a result, FIG. 13B-2 shows that a C band of ions covering a +6V range is ejected from this trap as the exit plate voltage is set to 120V. Therefore, it is clear that not all ions stored inside the trap are actually ejected from the trap: i.e., a typical IPED curve has a 20V FWHM, meaning that most ions are spread over an energy spectrum of 20V. Out of a 20V band of ions, only a 6V sliver is ejected out of the trap. This suggest that, in each RF sweep, at least ⅔ of the ions are left behind in the trap. One way suggested to improve dynamic range is to tighten the energy distribution of the ions stored in the trap so that more ions are ejected during each sweep. As described below, tightening the energy distribution has the double effect of increasing the number of ions ejected from the trap (i.e., increasing the dynamic range) as well as improving resolution. The difference between the EPED_Onset and exit plate voltage is believed to define the band of ion energies that can be ejected from the trap, and in doing so defines not only the sensitivity (i.e., how many ions are ejected and detected) but also the resolution (i.e. how long does it take to eject those ions).

Figure 13C:
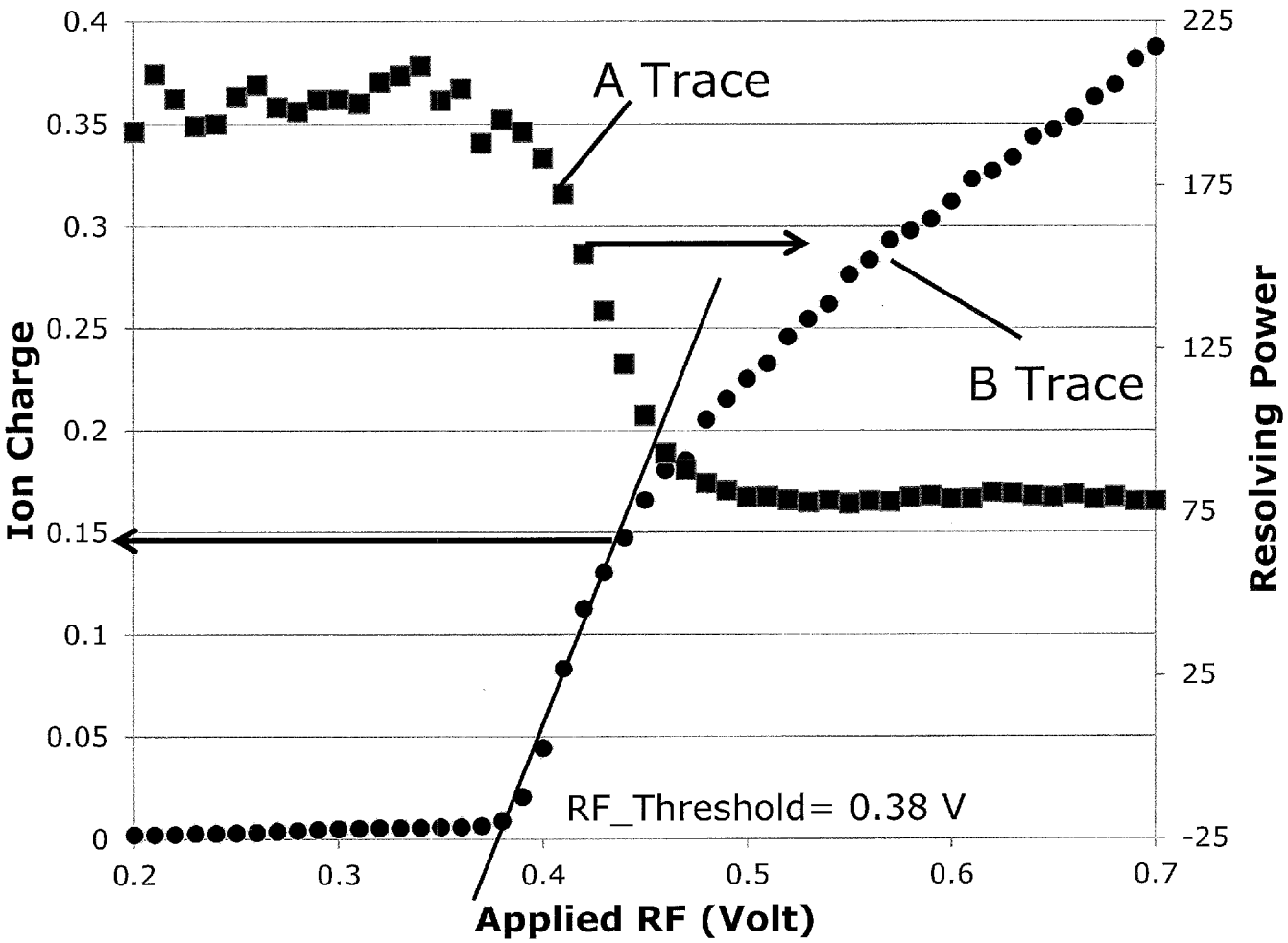
FIG. 13C is a graph of peak amplitude for a 28 amu peak and resolution as a function of RF amplitude.

The width of pulses ejected from electrostatic ion traps changes as a function of applied RF. As the RF increases, starting from the RF-Threshold, the resolution starts at its maximum and then drops until it reaches a minimum value. A further increase in RF does not change that resolution any more. FIG. 13C illustrates this effect. The A trace represents the resolving power (M/ΔM) for the 28 amu peak for pure $N_2$ at 28 amu. In all ion traps tested to date, the resolving power shows the exact same response to RF amplitude. The resolving power is at a maximum at the RF amplitude corresponding to the RF_Threshold and decreases monotonically as the RF amplitude increases. In general, the resolution reaches a minimum value, typically between 60 and 80, and further increases in applied RF have no impact on resolution. The A trace in FIG. 13C illustrates this phenomenon. The number of ions ejected from the trap increases monotonically as the RF applied is increased. Eventually, the peak amplitude (i.e., integrated area in time proportional to the number of ions ejected) also reaches a maximum. Note that most of the ion traps built to date have shown a very consistent dependence of the resolving power on RF Amplitude. In fact, even though some variation is expected in terms of how fast the resolving power decreases with RF amplitude, in general most ion traps reach the same resolving power at large RF settings. In most cases, the resolving power at the lower limit is somewhere between 60 and 80×. Operation at high RF settings is probably the best way to operate a trap to gain: 1) consistent resolution, 2) low variability from unit to unit, and 3) the most accurate ratios for peak amplitudes.

Without wishing to be bound by any particular theory, it is believed that the width of the pulses is closely related to the difference in energy between EPED_Onset and $V_{exit}$ bias. When the RF is very small, the ions are only mildly excited and no ejection can take place until DPED reaches +10V. As the RF continues to increase, DPED gets larger than +10V and a group of ion energies can be ejected from the trap. For example, for a 12V DPED, one can eject a group of ions corresponding to a 2V spread in the EPED curve. By the time normal performance is achieved, one typically has an EPED_Onset such that DPED=16V and one can eject a group of ions corresponding to 6V energy band. The width of the peak ejected is directly related to the fact that one needs to eject ions over a 6V energy band to get them all out. The 6V excitation will take time, as it can only be done with small increments of the RF on each RF oscillation. As a result, a pulse excited with more RF will eject more ions excited over a wider range of energies and will take longer to come out.

Figure 13D:
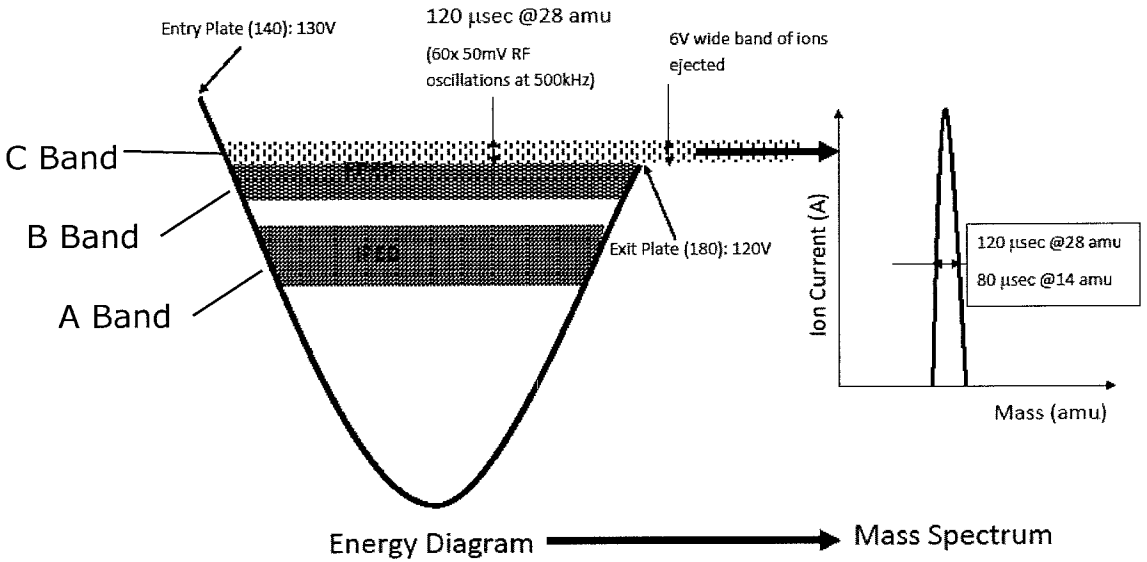
FIG. 13D is a schematic illustration of the excitation process for a band ions in a potential well inside an electrostatic ion trap showing the amount of time needed to eject the band of ions out of the ion trap.

There is indeed an excellent agreement between pulse width and the band of energies that can be ejected from the trap, as illustrated in FIG. 13D.

Figure 13E:
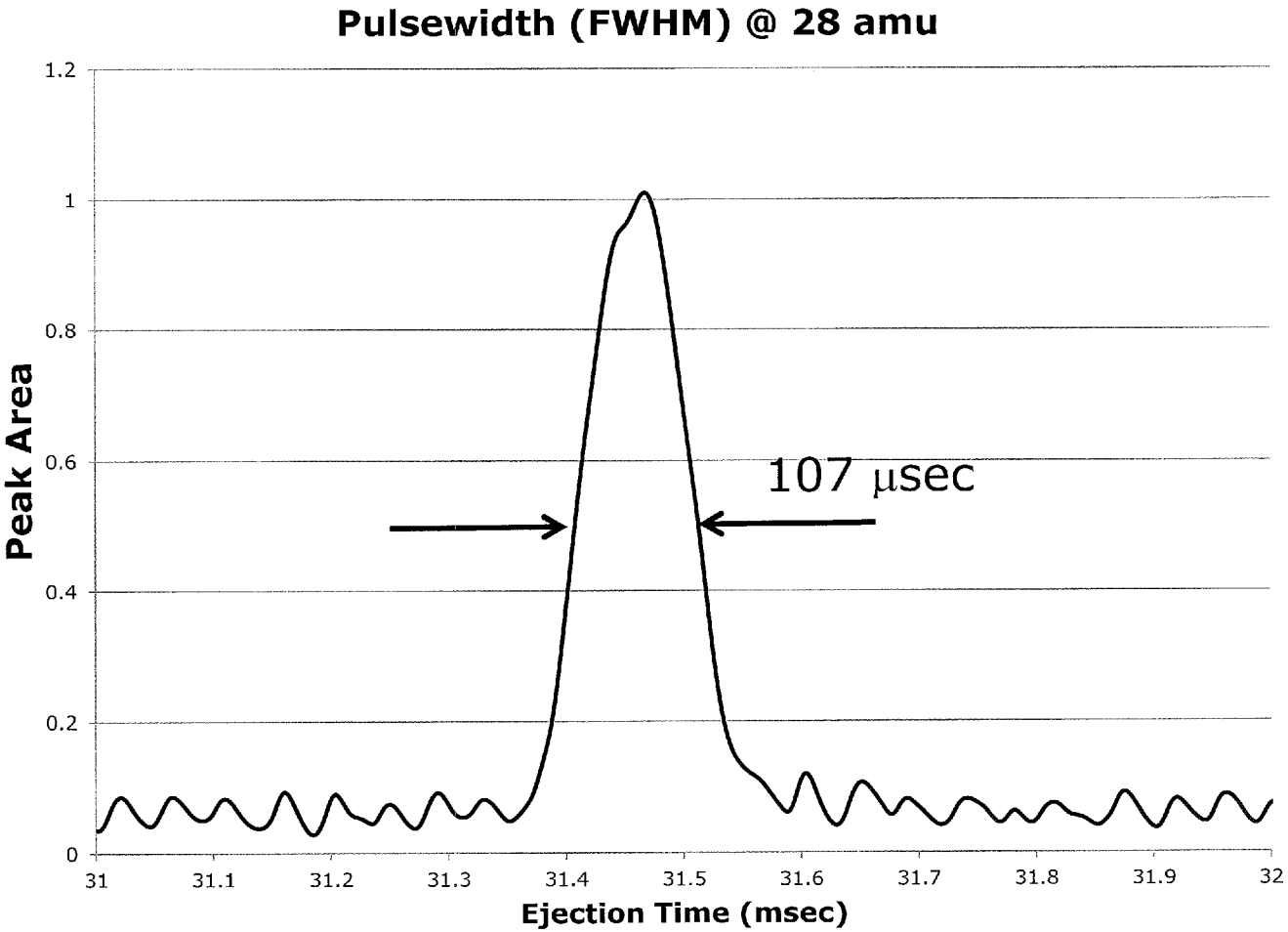
FIG. 13E is a graph of peak area as a function of ejection time for a 28 amu peak.
Figure 13F:
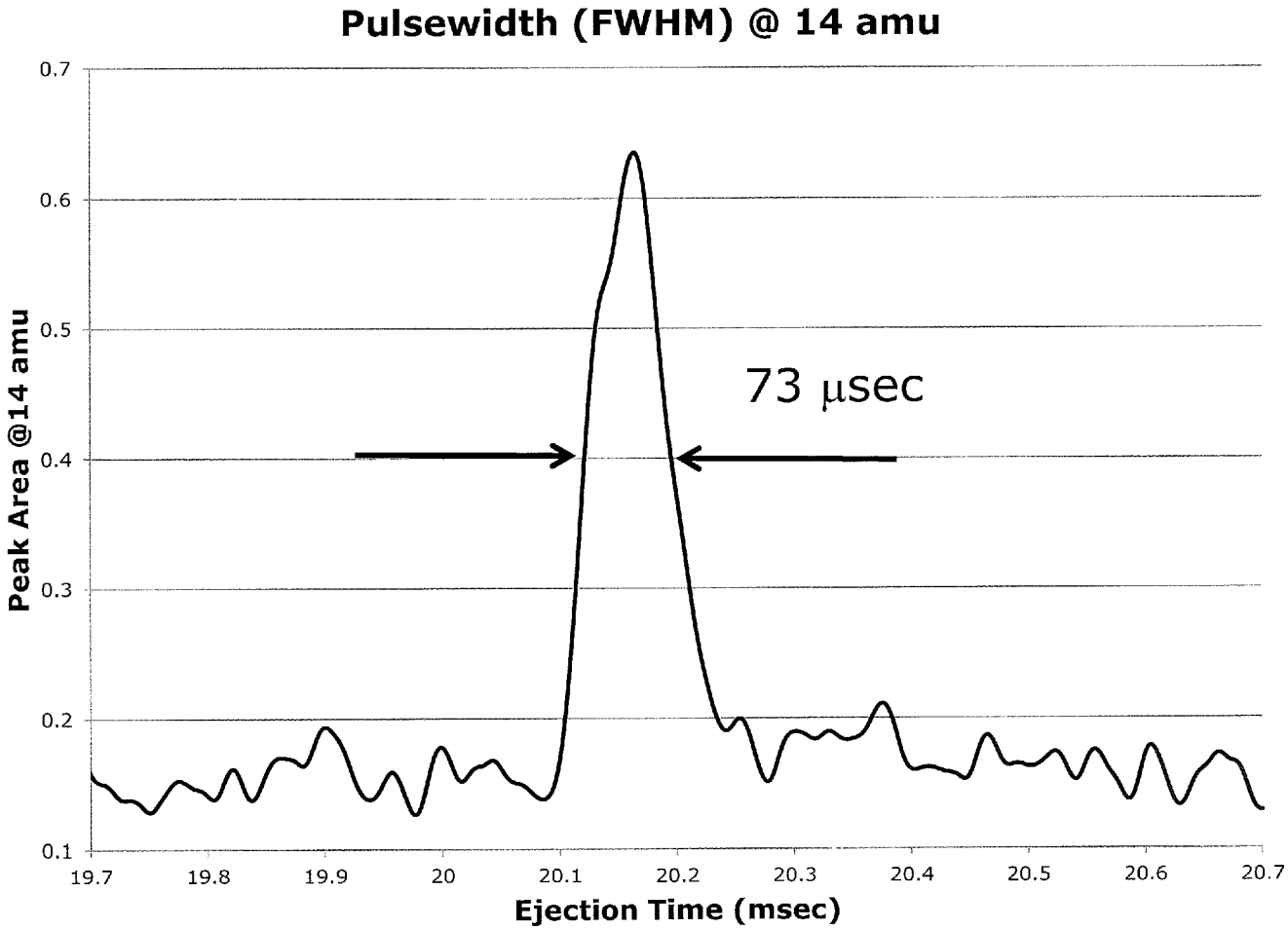
FIG. 13F is a graph of peak area as a function of ejection time for a 14 amu peak.

FIG. 13D illustrates the excitation process for the ions. The ions are formed inside the trap with an energy distribution that is represented by the A band. The ions oscillate back and forth within that band with energy-dependent oscillations. For Nitrogen ions in an ion trap, the frequency of oscillation is about 500 kHz, meaning that it takes 28 amu ions roughly 2 microseconds to perform a full oscillatory round trip. During the RF scan, the ions are excited by the RF and can gain as much as 16V in energy. However, the exit plate is set +10V above the IPED_Onset, so that a group of ions with a 6V energy spread will exit the trap during the excitation process. What this actually means is that ions will exit the trap while the 6V group is excited by the RF. In order for the RF to excite a 6V band of ions, 50 mV at a time, the RF will need to perform 120 pumps. Since the RF pumps at twice the NOF, this actually means 60 oscillations of the RF field, which corresponds to 120 microseconds. In other words, it will take 120 microseconds for a group of ions covering a 6V range to come out of the trap. This is in exact agreement with the pulse widths measured for the $N_2$ ions at 28 amu coming out of the trap. FIG. 13E shows a $N_2$ peak with a 107 microsecond pulse width. Note that it takes the ions formed inside the trap about 200 microseconds to reach the exit plate, and then an additional 120 microseconds to eject a 6V band of ions out of the exit plate grid. If the same calculation is repeated for ions at 14 amu that oscillate at a frequency closer to 700 kHz, the result will be a shorter amount of time for the ions to come out. In fact, to eject a 6V band of energies, it will be necessary to eject ions again over 60 oscillations of the RF, but this time that corresponds to roughly 80 microseconds. This is again in agreement with the pulse widths measured for ions at 14 amu as shown in FIG. 13F, which shows a 14 amu peak with a 73 microsecond pulse width.

Figure 15:
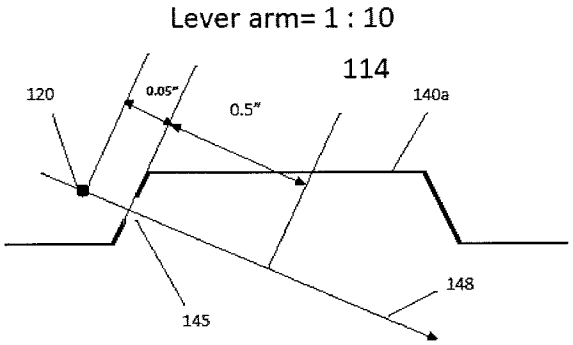
FIG. 15 is a schematic illustration of the effect of electron source filament position on electron beam position.

The performance (i.e., resolution, peak ratios and signal levels) of an electrostatic ion trap operated with an off-axis ion source is dependent on the energy distribution of ions formed inside the trap. Once the geometrical design and operational parameters for an electrostatic ion trap are selected, the ion energy distribution is defined by the point of origin of the ions within the axial potential well. Ions formed close to the entry plate 140 have higher initial potential energy (IPE) than ions formed farther inside the trap volume (i.e., closer to the entry pressure plate 150). In general, the ions formed inside the trap are expected to have a range of IPEs. The IPE of an ion is defined as the voltage of the equipotential line at which the ion is created. The width and center of mass of the IPE distribution within the axial potential well determine the specifications of the electrostatic ion trap. The exact alignment and positioning of the repeller 130/filament 120/entry slit 145 assembly have the largest effect on the position of the IPE band—as a result of the large lever arm that develops, shown in FIG. 15. During an RF scan, ions formed at high IPE (i.e., closer to the entry plate's back plane 140*a*) are ejected earlier from the trap than ions formed deeper inside the trap. The spread in energies leads to peak broadening, and in cases where ions are not uniformly distributed in energy, to misshapen peaks. A shift of the ion energy distribution to lower IPE values lowers the ejection efficiency for ions resulting in: (1) reduced signal levels, (2) increased resolving power and (3) misrepresented peak ratios. In general, it is possible to restore some of the performance by increasing the RF signal amplitude. A shift of the energy distribution to higher IPE values increases the ejection efficiency of ions resulting in: (1) higher signals, (2) reduced resolving power and (3) more representative peak ratios. In general, it is possible to restore some of the performance by decreasing the RF signal amplitude.

Figure 17:
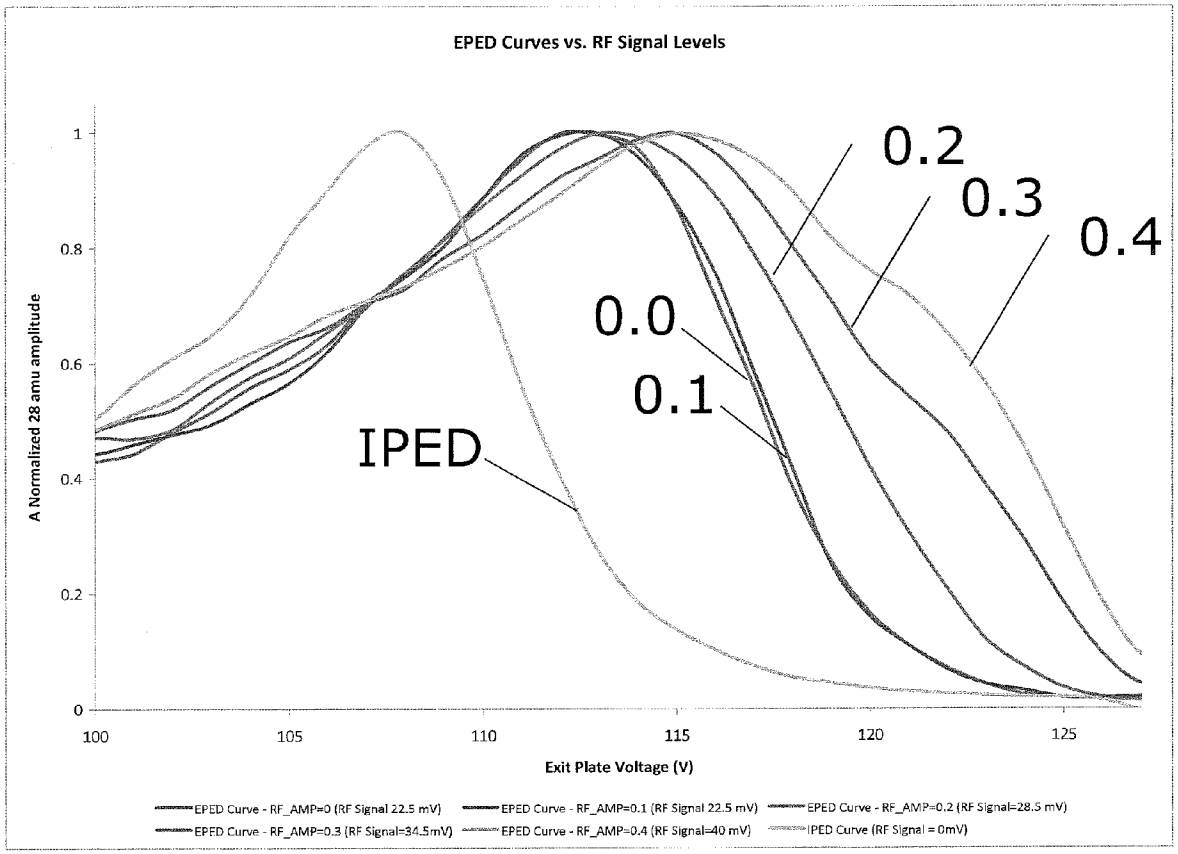
FIG. 17 is a graph of an IPED curve and EPED curves at different applied RF amplitude levels.
Figure 18:
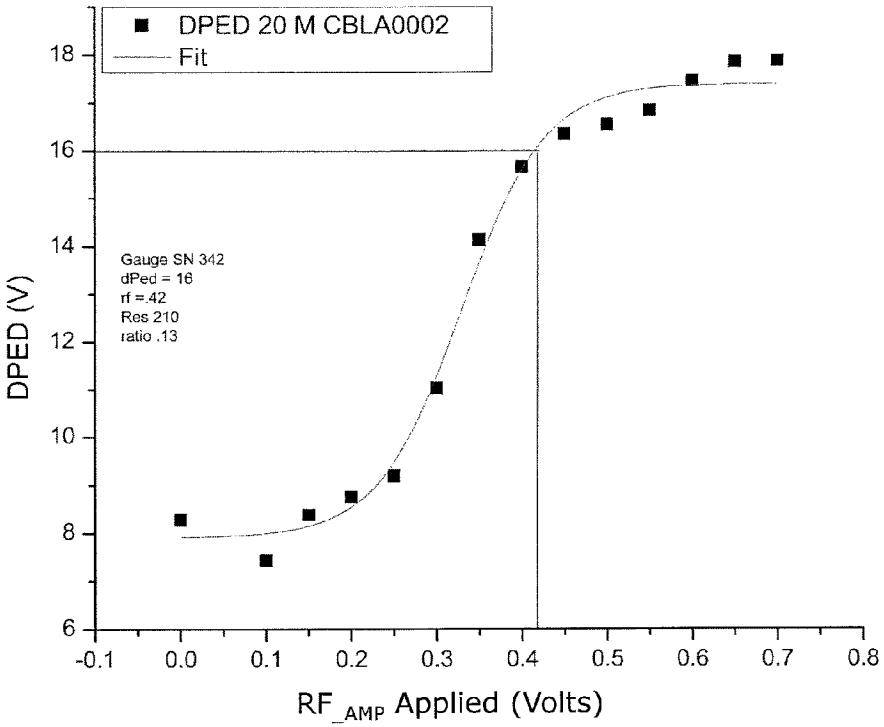
FIG. 18 is a graph of DPED as a function of applied RF excitation amplitude (volts).
Figure 19:
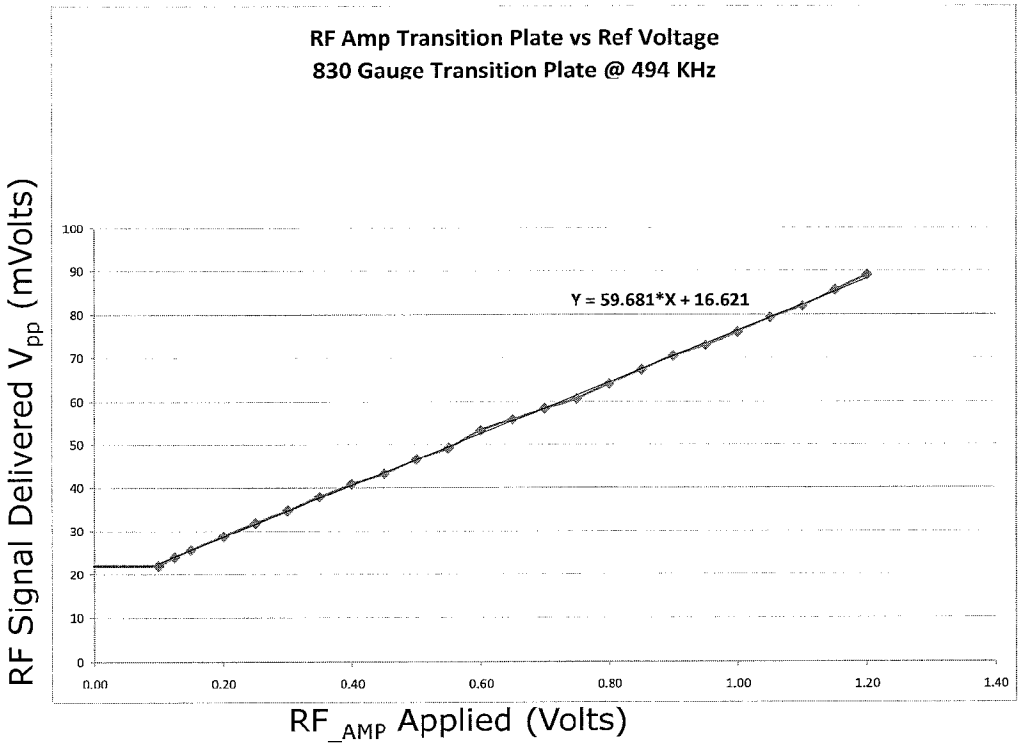
FIG. 19 is a graph of RF signal excitation delivered into the ion trap as a function of RF excitation amplitude applied on the ion trap controller.
Figure 20B:
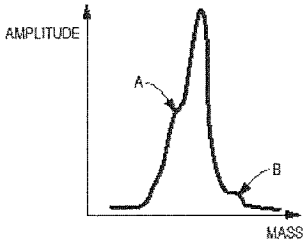
FIG. 20B is a graph of ion counts as a function of ion mass.
Figure 20A:
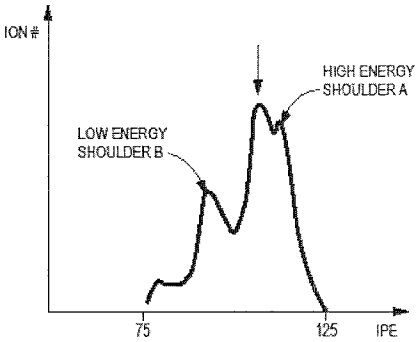
FIG. 20A is a graph of ion counts as a function of initial potential energy.

Turning back to FIG. 5A, once the IPED onset value and the trap parameters are adjusted relative to each other as described above, then, at step 340, the RF excitation level is adjusted by measuring at step 540, at an applied test RF excitation amplitude (e.g., $RF_{_AMP}$=0.5 V), the difference between the excited potential energy distribution (EPED) and the IPED. During the excited potential energy distribution test (EPEDT), the V_Exit is scanned the same way as in the IPEDT described above, but at each voltage step the area of the nitrogen peak is measured and stored. The analysis software tracks the shifts in the position and area under the nitrogen peak as the V_Exit changes, because V_Exit directly affects the mass axis calibration factor. This test is typically performed in pure nitrogen at 2.5E-7 Torr, same as the previous tests, and the peak area at 28 amu is used to quantify ion population as a function of V_Exit. Other test gases can also be used, with a different test peak mass. The output of the test is an EPEDT curve that looks very similar to the IPEDT test curve but shifted to higher $V_{Exit_Plate}$ values due to RF excitation. FIG. 16A shows a combined IPEDT and EPEDT graph obtained on an electrostatic ion trap. The tests of ion energies were performed at the $ECE_{Max}$ value determined from the ECET plot 810 shown in FIG. 8. From the calculated onsets for the EPED and IPED curves, determined from the linear (10%-90% rule) fits described above, it can seen that the 22.5 mV of RF signal excitation typically delivered into the trap when $RF_{_AMP}$=0 V shifts the ions up by 5.15V during a mass spectrum scan. As shown in FIG. 17, the onset of the EPED curve moves to higher potentials as the $RF_{_AMP}$ is increased from 0.0 V to 0.4 V. As shown in FIG. 18, DPED increases up to about 16 V for an applied RF Amp P-P of about 0.4 V. There is a linear relationship, shown in FIG. 19, between the $RF_{_AMP}$ applied by the controller and the RF signal excitation delivered into the ion trap. The relationship between the $RF_{_AMP}$ and RF signal is dependent on several factors, including variation in RF transmission of different cables. As shown in FIG. 19 and discussed above, there is a residual amount of RF signal (about 22 mVolts) delivered into the ion trap even when the controller is set to zero.

Turning back to FIG. 5A, at step 540, the applied $RF_{_AMP}$ is set to 0.5 V, and the EPED onset value is measured as described above, and the difference (DPED=EPED−IPED) between excited and initial onset values is obtained. If the DPED is greater than a specified DPED (e.g., 16 V) at step 545, then the applied $RF_{_AMP}$ is reduced by a small (e.g., 0.010 V) amount at step 550, and the DPED is recursively measured at steps 560 and 565 until the DPED is less than or equal to the specified DPED.

Once the RF excitation amplitude has been set as described above, then step 350 includes performing an electron multiplier voltage test (EMVT) at step 570. The EMVT can be performed either by determining, using the Faraday cup test described above (e.g., at the factory), an electron multiplier bias (EM_Bias) setting that yields an electron multiplier output current of about 25 nA for the typical ion current of 25 pA, thereby setting an electron multiplier gain of 1000, or by determining an EM_Bias setting for a baseline ion current offset (BICO) of about 25 nA (e.g., in the field). Then, if the EM_Bias setting at step 575 is less than a specified EM_Bias (e.g., 1050 V), the operational V_Exit, $V_{_EM_Shield}$, $RF_{_AMP}$ and EM_Bias settings are saved at step 580.

Figure 5C:
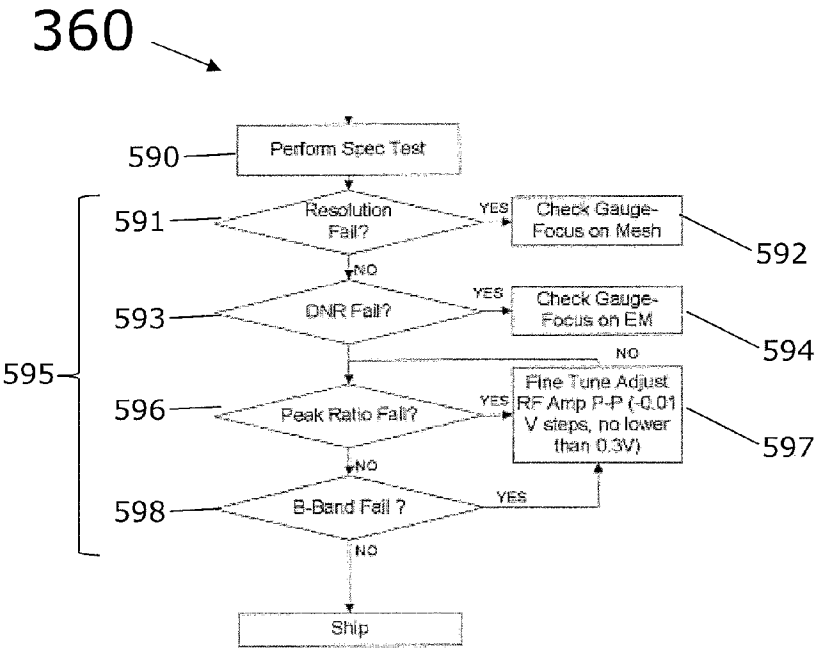
FIG. 5C is a flowchart of the process for performing spectral quality tests shown in FIGS. 5A and 5B.

The spectral quality test step 360, shown in FIG. 5C, includes generating test spectra at step 590 in order to determine, at step 595, whether the electrostatic ion trap has the specified resolution, dynamic range (DNR), peak ratio, and spectral B-band peak shape. The resolution (M/ΔM) full width at half maximum (FWHM) should be greater than or equal to a specified resolution (e.g., 150). The resolution can be measured on the 28 amu peak corresponding to singly ionized $N_2$ molecules. The measured resolution is actually the resolving power of the mass spectrometer at 28 amu, which is defined as the ratio of the mass divided by the peak width at FWHM. If the resolution is found, at step 591, to be less than the specified resolution, then, at step 592, the electrostatic ion trap is disassembled and the parts are inspected, particularly the exit plate mesh.

Dynamic range (DNR) can be defined as the ratio of the background-subtracted peak amplitude at 28 amu divided by the root-mean-square (RMS) of the baseline noise measured between 1.2 and 1.7 amu (or any other mass range in the spectrum where there are no peaks). The dynamic range is an excellent measurement of the minimum detectable peak amplitude. In general, a peak can be detected if its amplitude exceeds the RMS of the noise in the baseline. The DNR increases with the number of averages as the RMS of the baseline noise decreases. The DNR for 100 averages should equal or exceed a specified DNR (e.g., 500 at 28 amu). If the DNR is found, at step 593, to be less than the specified DNR, then, at step 594, the electrostatic ion trap is disassembled and the parts are inspected, particularly the electron multiplier (EM).

As discussed above, peak ratio is a measure of RF delivery and depends on the RF-Thresholds of the species being measured. The ratio of the peak amplitudes at 14 and 28 amu is calculated and expected to be in a range of between about 0.12 and about 0.18. If the peak ratio is found, at step 596, to be outside of this range, then, at step 597, the applied $RF_{_AMP}$ is decreased slightly (e.g., in steps of about 0.01 V), and the peak ratio is measured again. The applied $RF_{_AMP}$ should not be decreased to a value less than about 0.3 V. If the applied $RF_{_AMP}$ is decreased too much, the 28 amu ions can not get efficiently ejected. As a result, the amplitude of the 28 amu peak decreases, and the ratio of 14/28 increases. Since there is a much smaller number of ions at 14 amu, as the applied $RF_{_AMP}$ is decreased, the 28 amu peak will start to suffer RF depletion before the 14 amu peak does. The peak ratio determination is used to make sure that the spectra provided by the trap provide consistent peak ratios. A typical specified peak ratio can be about 0.16 with a standard deviation of 0.02.

The final spectral quality test is the spectral peak shape or B-band test. B-Band peaks appear to the right (i.e., high mass) side of the main peaks. A B-band peak can be defined as a satellite peak that appears within 0.3 amu of any peak in the spectrum and has an amplitude that is at least 10% of the main peak. If, at step 598, B-bands are observed, then, at step 597, the applied $RF_{_Amp}$ can be reduced in an effort to minimize B-band presence.

B-band ions have a higher RF_Threshold than the main peak ions, and so as a result the B-band disappears first as the RF amplitude is decreased. Once the B-band peak is minimized below threshold, then it is typically necessary to repeat the DNR and peak ratio tests at steps 593 and 596, respectively, as described above.

Figure 23B:
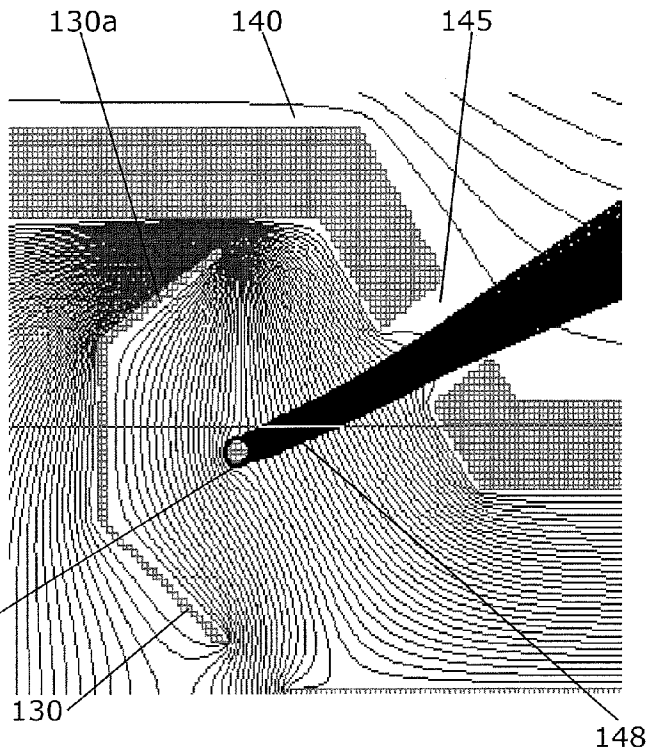
FIGS. 23A and 23B are schematic illustrations of an electron source with an extended repeller, showing a model of the resulting electric field lines and (FIG. 23B) electron beam.

As discussed above, the exact details of the repeller 130/filament 120/entry slit 145 alignment contribute to unit-to-unit performance variations. In order to further minimize this variability, in one embodiment shown in FIG. 23A, the repeller 130 can include an extension 130*a* located between the filament 120 and the entry plate 140, the repeller 130 shielding the filament 120 from the entry plate potential, thereby making the electric field lines more uniformly parallel between the filament 120 and the entry slit 145. The result, shown by comparing the electron beam 148 in FIG. 23B with the electron beam 148 shown in FIG. 12, is improved focusing of the electron beam 148 through the entry slit 145. Note that in FIG. 12 a portion of the electron beam 148 hits the back of the entry plate 140 instead of emerging through the entry slit 145. Coupling the majority of the electron beam 148 through the entry plate slit 145 and into the ionization region produces an electron coupling efficiency ECE_Max that is less dependent on the repeller voltage $V_{Repeller}$, enabling the tuning of the IPED_Onset by varying $V_{Repeller}$ while affecting the number of electrons introduced into the ionization region to a lesser extent than previous electron source designs. The extended repeller electron source produced, as shown in FIG. 24A, a variation of ECE_Max of about 10% over a range of $V_{Repeller}$ from −60 V to −20V, which is much smaller than the 40-60% variation in ECE_Max over the same range of $V_{Repeller}$ typically obtained with the electron source design shown in FIG. 1B, while providing a variation in IPED_Onset from about 113 V to about 93 V over the same range of $V_{Repeller}$. Turning back to FIG. 23A, the extension 130*a* of the repeller 130 can be a semi-circle, or any other shape that yields the desired electric field lines parallel to the entry plate slit 145.

Figure 23A:
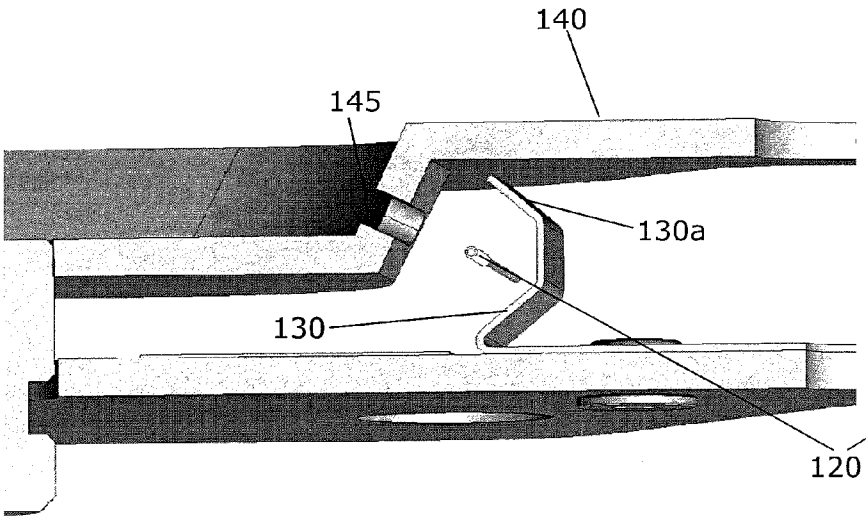
Figure 24A:
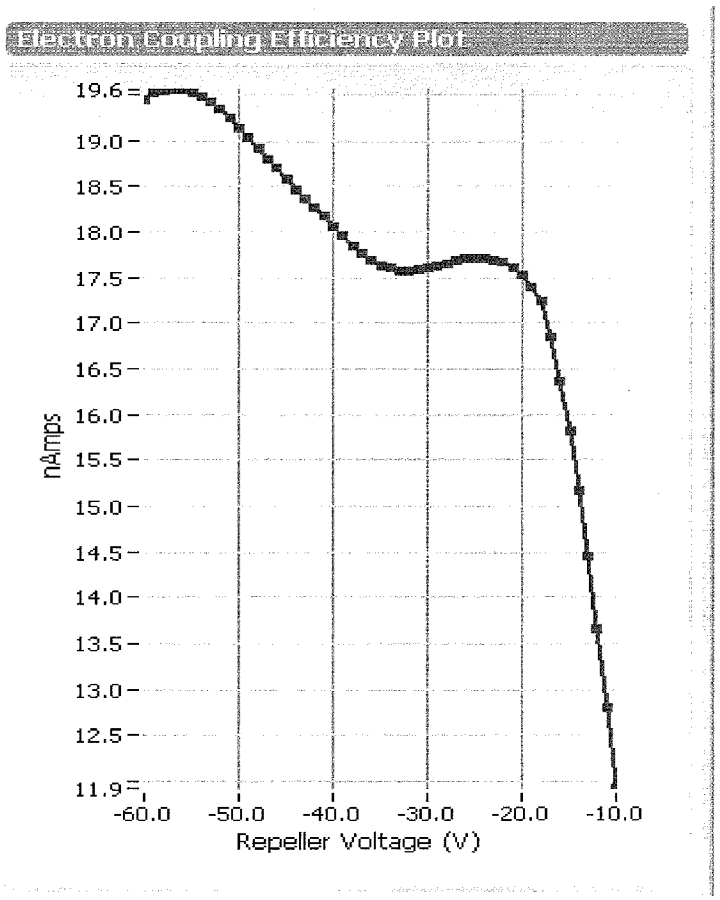
FIG. 24A is a graph of the ECE_Max as a function of repeller voltage obtained for the electron source shown in FIGS. 23A and 23B.
Figure 24B:
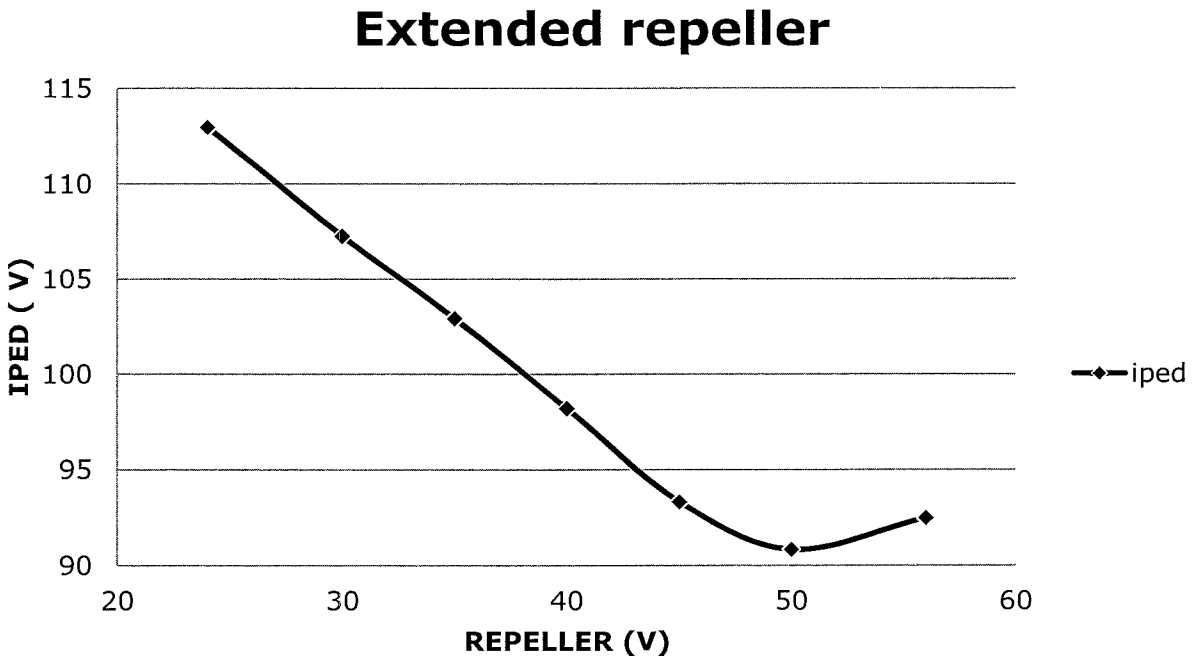
FIG. 24B is a graph of the IPED as a function of repeller voltage obtained for the electron source shown in FIGS. 23A and 23B.
Figure 25B:
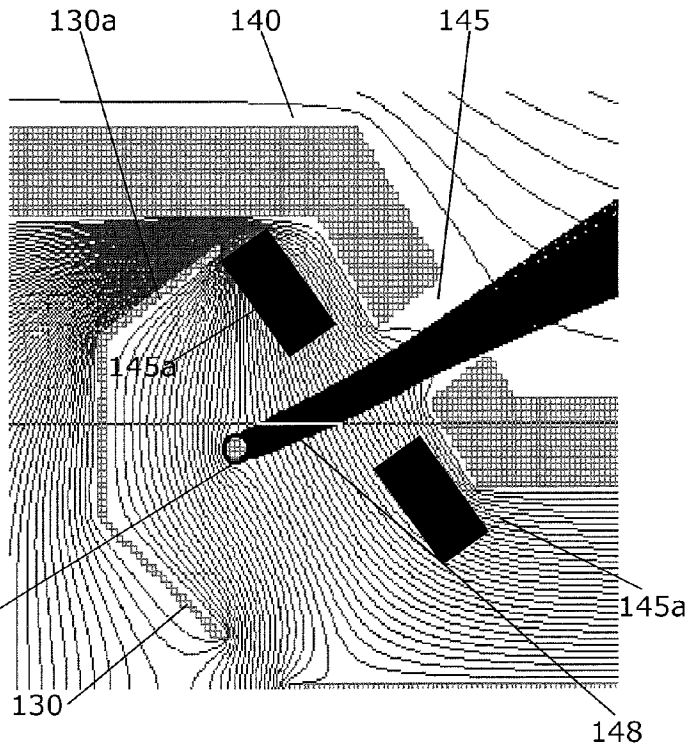
FIGS. 25A and 25B are schematic illustrations of an electron source with an extended repeller and an electrostatic lens, showing a model of the resulting electric field lines and (FIG. 25B) electron beam.
Figure 25A:
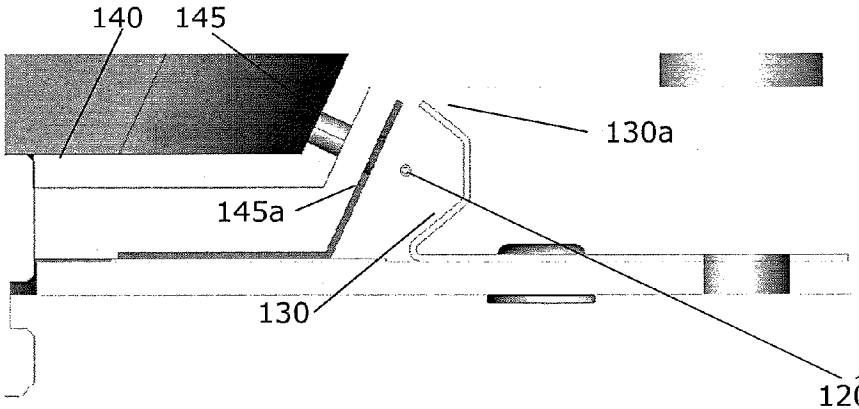

Another improvement in focusing the electron beam 148 through the entry plate slit 145 for either the electron source shown in FIG. 1B or the extended electron source shown in FIG. 23A, is shown in FIGS. 25A and 25B, where the electron source includes an electrostatic lens 145*a* located between the filament 120 and the entry plate slit 145, the electrostatic lens 145*a* collimating the electron beam 148 on its way into the ionization region. The electrostatic lens 145*a* can be a flat plate with a slit that is slightly larger than the entry plate slit 145. The electrostatic lens 145*a* can be an integral part of the filament tension spring assembly and biased at the same voltage as the filament 120 (typically about +30 V), or, optionally, the electrostatic lens 145*a* can be biased in a range of between about +15 V and about +30 V. The electrostatic lens enables tuning of the location of the ionization region within the ion trap by adjusting the filament bias voltage instead of, or in addition to, the repeller voltage.

Figure 21A:
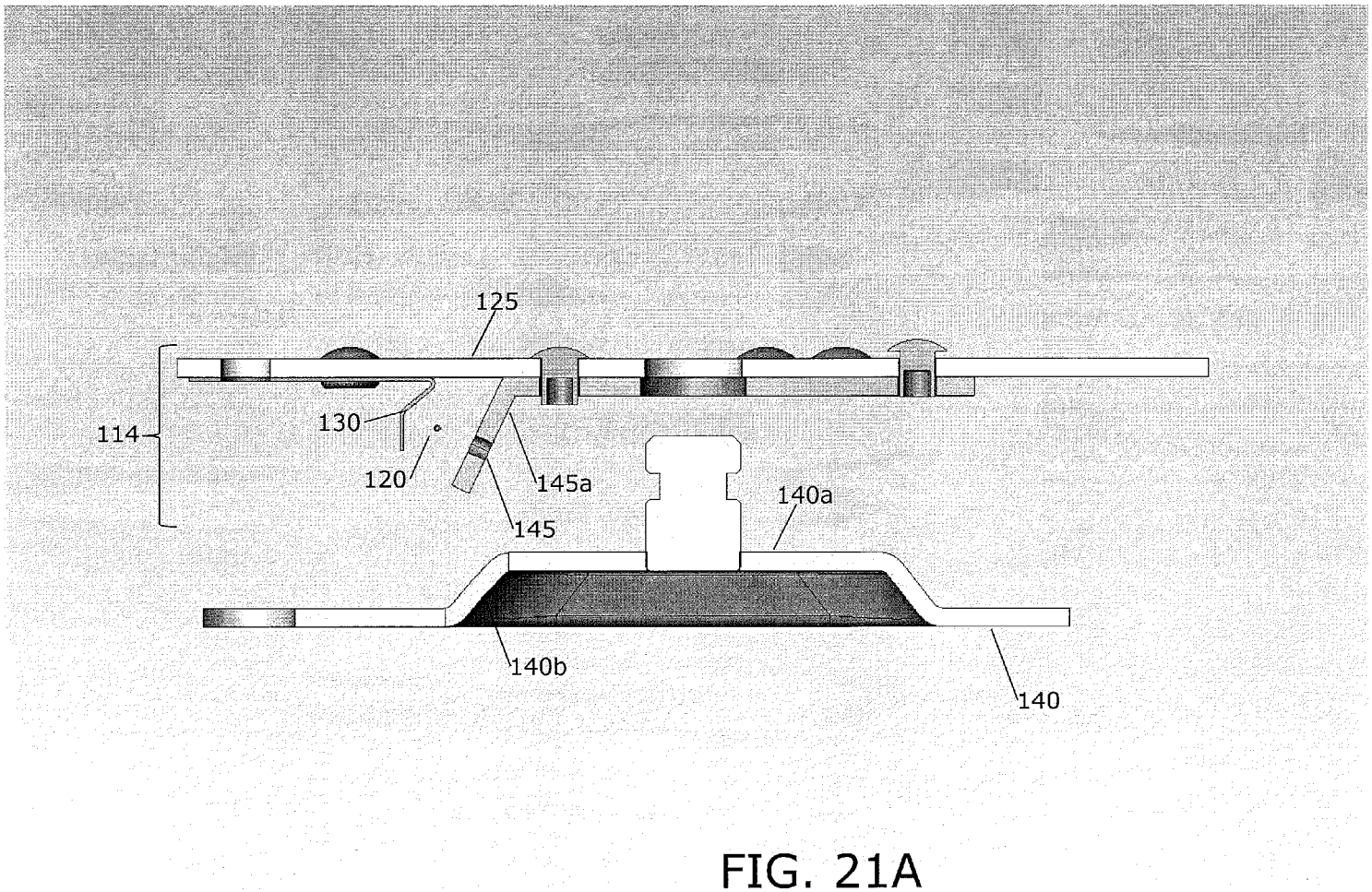
FIG. 21A is a schematic illustration of an uncoupled view of a unified FRU/entry slit design.
Figure 21B:
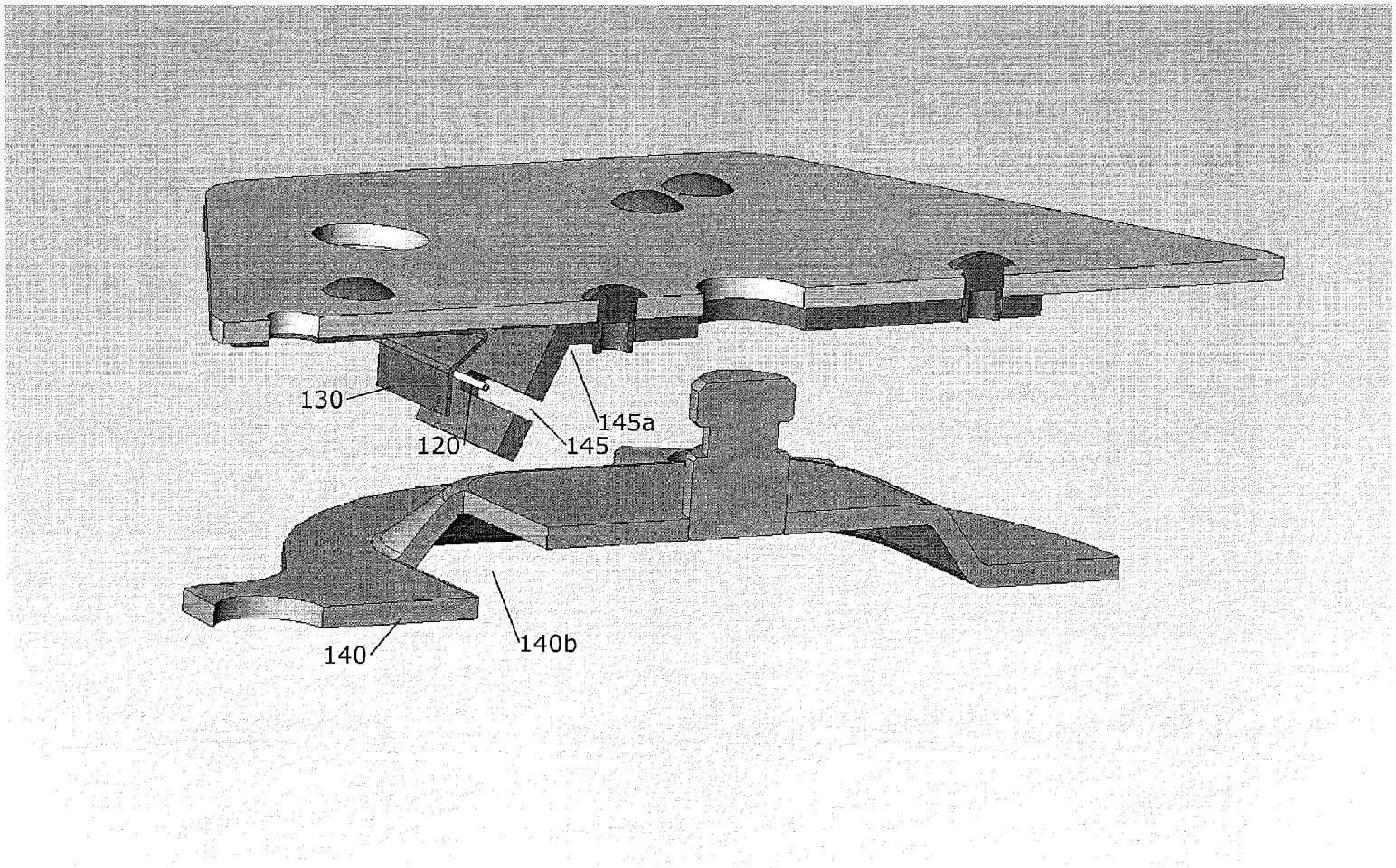
FIG. 21B is a perspective view of an uncoupled view of a unified FRU/entry slit design.
Figure 22:
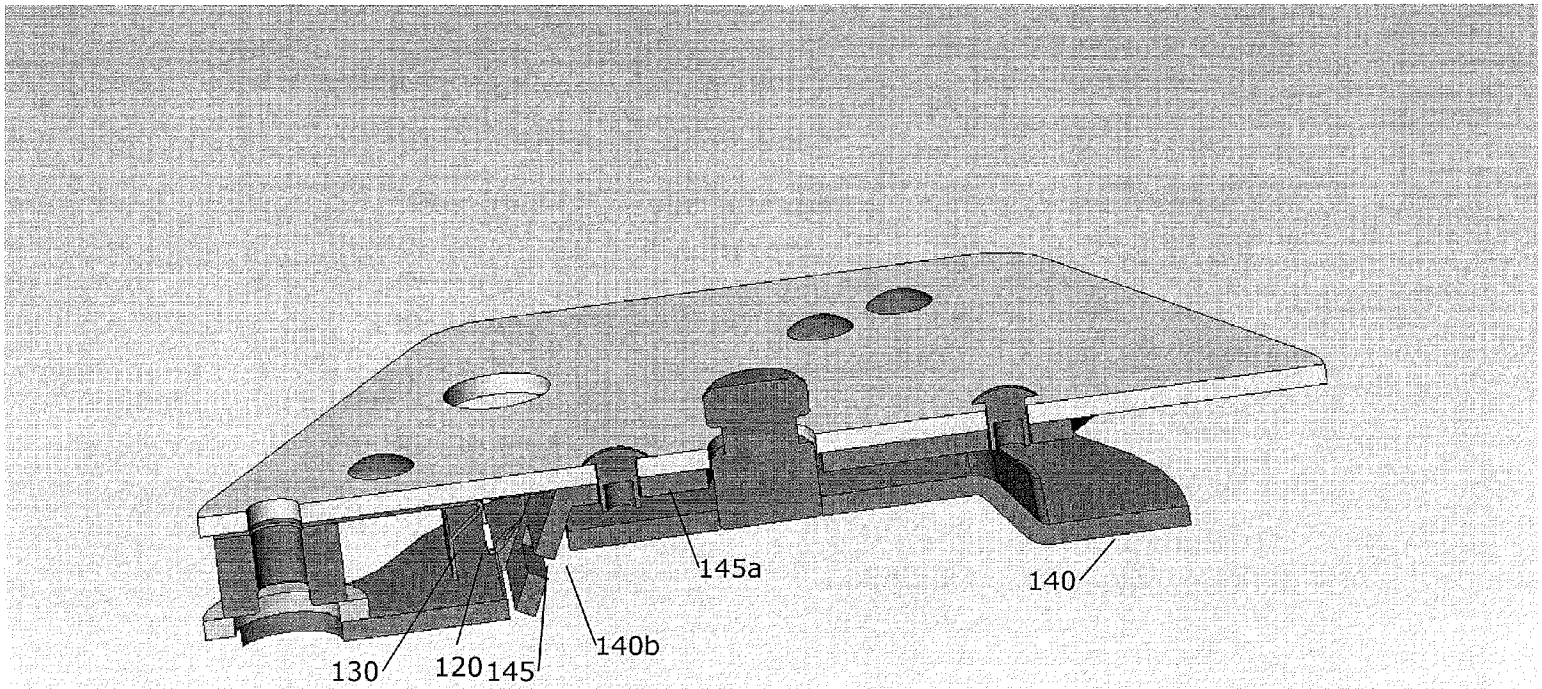
FIG. 22 is a schematic illustration of a coupled view of a unified FRU/entry slit design.

Another approach to producing reproducible electron beam trajectories and minimizing the problems described above is to provide a unified field replaceable unit (FRU) electron source and entry slit assembly shown unified in FIG. 22 and separated as entry slit assembly 114 in FIG. 21A, where the entry slit 145 is part of the FRU assembly 114 and is replaced every time the FRU is replaced. The entry slit 145 can include the electrostatic lens 145*a* described above. A replaceable slit 145 eliminates the need to do maintenance on the trap after a few FRU replacements. As shown in FIG. 21B, the entry plate 140 has an opening 140*b* which accommodates the entry slit plate 145*a* when the FRU is installed. There is an electrical connection between the entry slit plate 145*a* and the entry plate 140 once the FRU is installed. As shown in FIG. 22, the entry slit plate 145*a* covers the side opening 140*b* on the entry plate 140 and preserves the proper repeller 130/filament 120/entry slit 145 alignment relative to the test fixture. Advantages of the design shown in FIGS. 21A, 21B, and 22 include:

1. The slit 145 is replaced every time a FRU is replaced. This eliminates the need to maintain cleanliness on the entry slit 145 after a few FRU replacements, i.e., requires less maintenance.

2. The FRU assembly is tested as a unit so that the repeller 130/filament 120/entry slit 145 alignment established in a test fixture is preserved after the FRU is installed in a particular ion trap. There is no risk of mismatch between components in the test fixture relative to the particular ion trap.

3. There is no dimensional tolerance requirement on the stack-up between the repeller 130/filament 120 and the entry slit plate 145*a*, and therefore any FRU 114 should work with any trap 100.

4. Both electron flux levels and electron beam trajectory can be fully tested at the factory in a relatively simple test fixture using the tests described above. The tests will quickly reveal if the FRU assembly will work on any trap, without requiring matching of a particular FRU assembly 114 to a particular electrostatic ion trap 100.

The relevant teachings of all patents, published applications and references cited herein are incorporated by reference in their entirety.

While this invention has been particularly shown and described with references to example embodiments thereof, it will be understood by those skilled in the art that various changes in form and details may be made therein without departing from the scope of the invention encompassed by the appended claims. For example, the parameter ranges acceptable for tuning described here only apply to the specific ion trap design illustrated in FIG. 1A. Accordingly, new parameter ranges will be required for different trap designs and for different operational parameters.

What is claimed is:

1. A method of tuning an electrostatic ion trap, the method comprising, under automatic electronic control:

i) measuring parameters of the ion trap, the trap including an ion source having an electron source;

ii) adjusting ion trap settings based on the measured parameters; and iii) employing the ion trap settings and producing test spectra from a test gas at a specified pressure.

2. The method of claim 1, wherein adjusting ion trap settings includes adjusting electron source settings.

3. The method of claim 1, wherein measuring parameters of the ion trap further includes measuring an amount of ions being formed by collisions between electrons and a specified pressure of a test gas as a function of an electron source repeller bias.

4. The method of claim 3, wherein adjusting ion trap settings further includes increasing the amount of ions being formed at an electron source filament current.

5. The method of claim 3, further comprising setting the electron source repeller potential bias to a setting that yields a maximum baseline ion current at an electron source filament current.

6. The method of claim 3, wherein increasing the amount of ions being formed includes increasing the amount of ions to a maximum of the amount of ions being formed at an electron source filament current.

7. The method of claim 1, wherein measuring parameters of the ion trap includes measuring an ion initial potential energy distribution (IPED) within the trap at a specified pressure of a test gas.

8. The method of claim 7, wherein measuring the IPED includes measuring an IPED onset value.

9. The method of claim 7, wherein the trap further includes an ion exit gate having an ion exit gate potential bias, and wherein adjusting ion trap settings further includes providing relative adjustment between the ion initial potential energy distribution (IPED) and the ion exit gate potential bias.

10. The method of claim 9, wherein providing relative adjustment between the IPED and the ion exit gate potential bias includes setting the ion exit gate potential bias based on an IPED onset value.

11. The method of claim 10, wherein providing relative adjustment between the IPED onset value and the ion exit gate potential bias further includes setting an electron multiplier shield potential bias based on the IPED onset value.

12. The method of claim 9, wherein providing relative adjustment between the IPED and the ion exit gate potential bias includes adjusting an electron source repeller potential bias and an electron source filament bias to yield a specified IPED onset value.

13. The method of claim 1, wherein measuring parameters of the ion trap includes measuring a minimum amount of applied RF excitation required to detect an ion signal of a specific ion mass.

14. The method of claim 13, further including setting the RF excitation to an operational RF excitation setting that yields a specified peak ratio.

15. The method of claim 13, wherein measuring parameters of the ion trap further includes measuring the ion signal as a function of applied RF excitation.

16. The method of claim 1, wherein measuring parameters of the ion trap includes measuring an ion initial potential energy distribution (IPED) onset value and measuring an ion excited potential energy distribution (EPED) onset value at a test RF excitation setting.

17. The method of claim 16, further including setting the test RF excitation setting to an operational RF excitation setting that yields a specified difference between the EPED and IPED onset values.

18. The method of claim 16, further including setting the test RF excitation setting to an operational RF excitation setting that yields a specified spectral resolution.

19. The method of claim 16, further including setting the test RF excitation setting to an operational RF excitation setting that yields a specified dynamic range.

20. The method of claim 16, further including setting the test RF excitation setting to an operational RF excitation setting that yields a specified peak ratio of specified peaks in test spectra.

21. An apparatus comprising:

i) an electrostatic ion trap, the trap including an ion source having an electron source; and ii) electronics configured to measure parameters of the ion trap and configured to adjust ion trap settings based on the measured parameters and configured to employ the ion trap settings to produce test spectra from a test gas at a specified pressure.

22. The apparatus of claim 21, wherein the electron source includes:

an entry slit assembly, including an entry plate having an entry plate potential bias;

a filament; and a repeller that forms a beam of electrons from the filament and directs the electrons through the entry slit, the repeller having an extension located between the filament and the entry plate, the repeller shielding the filament from the entry plate potential.

23. The apparatus of claim 21, wherein the electron source includes an entry slit assembly having an electrostatic lens located between the filament and the entry slit, the electrostatic lens collimating an electron beam from the filament through the entry slit.

24. The apparatus of claim 21, wherein the electron source includes a unified electron source and entry slit assembly.

25. The apparatus of claim 21, wherein adjusting ion trap settings includes adjusting electron source settings.

26. The apparatus of claim 21, wherein the electronics are further configured to measure an amount of ions being formed by collisions between electrons and a specified pressure of a test gas and further configured to adjust electron source settings to increase the amount of ions being formed at an electron source filament current.

27. The apparatus of claim 26, wherein increasing the amount of ions being formed includes increasing the amount of ions to a maximum of the amount of ions being formed at an electron source filament current.

28. The apparatus of claim 26, wherein the electronics are further configured to set an electron source repeller potential bias to a setting that yields a maximum baseline ion current at an electron source filament current.

29. The apparatus of claim 21, wherein the trap further includes an ion exit gate having an ion exit gate potential bias, and wherein the electronics are further configured to provide a relative adjustment between an ion initial potential energy distribution (IPED) and the ion exit gate potential bias.

30. The apparatus of claim 29, wherein providing relative adjustment between the IPED and the ion exit gate potential bias includes setting the ion exit gate potential bias based on an IPED onset value.

31. The apparatus of claim 30, wherein providing relative adjustment between the IPED and the ion exit gate potential bias further includes setting an electron multiplier shield potential bias based on the IPED onset value.

32. The apparatus of claim 29, wherein providing relative adjustment between the IPED and the ion exit gate potential bias includes measuring an IPED onset value and adjusting an electron source repeller potential bias and an filament bias to yield a specified IPED onset value.

33. The apparatus of claim 21, wherein the electronics are further configured to measure a minimum amount of applied RF excitation required to detect an ion signal of a specific ion mass.

34. The apparatus of claim 33, wherein the electronics are further configured to set the RF excitation to an operational RF excitation setting that yields a specified peak ratio.

35. The apparatus of claim 33, wherein the electronics are further configured to measure the ion signal as a function of applied RF excitation.

36. The apparatus of claim 21, wherein measuring parameters of the ion trap includes measuring an ion initial potential energy distribution (IPED) onset value and an ion excited potential energy distribution (EPED) onset value at a test RF excitation setting.

37. The apparatus of claim 36, wherein the electronics are further configured to set the test RF excitation setting to an operational RF excitation setting that yields a specified difference between the EPED and IPED onset values.

38. The apparatus of claim 36, wherein the electronics are further configured to set the test RF excitation setting to an operational RF excitation setting that yields a specified spectral resolution.

39. The apparatus of claim 36, wherein the electronics are further configured to set the test RF excitation setting to an operational RF excitation setting that yields a specified dynamic range.

40. The apparatus of claim 36, wherein the electronics are further configured to set the test RF excitation setting to an operational RF excitation setting that yields a specified peak ratio of specified peaks in test spectra.

* * * * *